US011891739B2

(12) United States Patent
Kamihira et al.

(10) Patent No.: US 11,891,739 B2
(45) Date of Patent: Feb. 6, 2024

(54) SEWING DATA EDITING DEVICE, NON-TRANSITORY COMPUTER-READABLE MEDIUM, AND SEWING MACHINE

(71) Applicant: BROTHER KOGYO KABUSHIKI KAISHA, Nagoya (JP)

(72) Inventors: Yuta Kamihira, Ama (JP); Chiyo Koga, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 164 days.

(21) Appl. No.: 17/678,183

(22) Filed: Feb. 23, 2022

(65) Prior Publication Data

US 2022/0275550 A1 Sep. 1, 2022

(30) Foreign Application Priority Data

Feb. 26, 2021 (JP) ..... 2021-030382

(51) Int. Cl.
*D05B 19/08* (2006.01)
*D05B 19/12* (2006.01)

(52) U.S. Cl.
CPC ..... *D05B 19/08* (2013.01); *D05B 19/12* (2013.01)

(58) Field of Classification Search
CPC ..... D05B 19/08; D05B 19/10; D05B 19/14; D05B 53/00
See application file for complete search history.

(56) References Cited

U.S. PATENT DOCUMENTS

| | | | | |
|---|---|---|---|---|
| 5,537,945 | A * | 7/1996 | Sugihara | D05B 19/02 112/155 |
| 8,061,286 | B2 * | 11/2011 | Hirata | D05C 5/04 112/102.5 |
| 10,876,238 | B2 * | 12/2020 | Kongo | D05C 7/00 |
| 10,995,437 | B2 * | 5/2021 | Kongo | D05B 19/08 |
| 11,268,222 | B2 * | 3/2022 | Tanaka | D05B 39/00 |
| 11,649,575 | B2 * | 5/2023 | Kongo | D05B 19/08 112/154 |
| 2021/0285139 | A1 * | 9/2021 | Kongo | D05B 19/08 |
| 2022/0403573 | A1 * | 12/2022 | Tsuchiya | D05B 19/105 |

FOREIGN PATENT DOCUMENTS

| | | | |
|---|---|---|---|
| JP | H08-311761 | A | 11/1996 |
| JP | 2007-000501 | A | 1/2007 |
| JP | 2009-233435 | A | 10/2009 |

* cited by examiner

*Primary Examiner* — Tajash D Patel
(74) *Attorney, Agent, or Firm* — Oliff PLC

(57) ABSTRACT

A sewing data editing device includes a processor and a memory configured to store computer-readable instructions that, when executed by the processor, instruct the processor to perform processes. The processes include acquisition processing of acquiring coordinate data representing a position of each of a plurality of points along a predetermined pattern, corner portion detection processing of detecting, based on the coordinate data, a corner portion having an angle smaller than a predetermined angle, and editing processing of editing sewing data, based on the coordinate data of each of the plurality of points and on a detection result of the corner portion detection processing, using editing conditions that are mutually different for a plurality of first needle drop points corresponding to the corner portion and for a plurality of second needle drop points corresponding to a non-corner portion not detected as the corner portion, in the predetermined pattern.

12 Claims, 11 Drawing Sheets

| TYPE | THICKNESS | SOFTNESS | SECOND INTERVAL | ··· |
|---|---|---|---|---|
| FIRST CORD MEMBER | 5 mm | 0 | FIRST DISTANCE | ··· |
| SECOND CORD MEMBER | 4 mm | 1 | SECOND DISTANCE | ··· |
| ⋮ | ⋮ | ⋮ | ⋮ | ⋮ |

87

SEWING DATA EDITING DEVICE, NON-TRANSITORY COMPUTER-READABLE MEDIUM, AND SEWING MACHINE

CROSS REFERENCE TO RELATED APPLICATIONS

This application claims priority to Japanese Patent Application No. 2021-030382 filed Feb. 26, 2021, the content of which is hereby incorporated herein by reference in its entirety.

BACKGROUND

The present disclosure relates to a sewing data editing device, a non-transitory computer-readable medium, and sewing machine.

A sewing data editing device is known that generates sewing data for performing couching, using a sewing machine, that forms a pattern on a sewing object by fastening, with stitches, a cord member, such as wool, an ornamental thread, a ribbon and the like, onto the sewing object. The sewing data editing device can generate, from image data representing the pattern, sewing data for performing normal embroidery, and the sewing data for performing the couching. The sewing data editing device receives an input of a thickness and a type of the cord member, and generates decorative stitch data of a stitch pitch and a stitch width depending on an input result.

SUMMARY

When the sewing machine performs the couching using the sewing data generated by the above-described sewing data editing device, there are times when the cord member is not sewn to the sewing object at corner portions of the pattern.

Embodiments of the broad principles derived herein provide a sewing data editing device, a non-transitory computer-readable medium, and a sewing machine configured to generate sewing data offering an improved possibility, compared to known art, that a cord member is sewn to a sewing object at corner portions of a pattern, when couching is performed using the sewing machine.

Embodiments provide a sewing data editing device that includes a processor and a memory configured to store computer-readable instructions that, when executed by the processor, instruct the processor to perform processes. The processes include acquisition processing of acquiring coordinate data representing a position of each of a plurality of points along a predetermined pattern, corner portion detection processing of detecting, based on the coordinate data of each of the plurality of points, a corner portion, in the predetermined pattern, having an angle smaller than a predetermined angle, and editing processing of editing sewing data, based on the coordinate data of each of the plurality of points and on a detection result of the corner portion detection processing, using editing conditions that are mutually different for a plurality of first needle drop points corresponding to the corner portion and for a plurality of second needle drop points corresponding to a non-corner portion not detected as the corner portion, in the predetermined pattern. The sewing data is data for performing couching, using a sewing machine, to directly sew a cord member onto a sewing object, by forming a plurality of sewing stitches penetrating the cord member and the sewing object along the predetermined pattern. The sewing data editing device is configured to edit the sewing data using the conditions that are different for the corner portion and for the non-corner portion in the pattern. According to the sewing data editing device, as a result of a user appropriately setting the editing conditions, in comparison to a case in which the editing conditions are the same for the corner portion and the non-corner portion of the predetermined pattern, the cord member is less likely to become detached from the sewing object at the corner portion, and the couching pattern having an attractive appearance can be obtained.

Embodiments also provide a non-transitory computer-readable medium that stores computer-readable instructions that are executed by a processor of a sewing data editing device. The computer-readable instructions performing processes. The processes include acquisition processing of acquiring coordinate data representing a position of each of a plurality of points along a predetermined pattern, corner portion detection processing of detecting, based on the coordinate data of each of the plurality of points, a corner portion, in the predetermined pattern, having an angle smaller than a predetermined angle, and editing processing of editing sewing data, based on the coordinate data of each of the plurality of points and on a detection result of the corner portion detection processing, using editing conditions that are mutually different for a plurality of first needle drop points corresponding to the corner portion and for a plurality of second needle drop points corresponding to a non-corner portion not detected as the corner portion, in the predetermined pattern. The sewing data is data for performing couching, using a sewing machine, to directly sew a cord member onto a sewing object, by forming a plurality of sewing stitches penetrating the cord member and the sewing object along the predetermined pattern. The sewing data editing device that executes the processes according to instructions stored in the non-transitory computer-readable medium, can edit the sewing data using the conditions that are different for the corner portion and for the non-corner portion in the pattern. According to the sewing data editing device that executes the processes according to instructions stored in the non-transitory computer-readable medium, as a result of a user appropriately setting the editing conditions, in comparison to a case in which the editing conditions are the same for the corner portion and the non-corner portion of the predetermined pattern, the cord member is less likely to become detached from the sewing object at the corner portion, and the couching pattern having an attractive appearance can be obtained.

Embodiments further provide a sewing machine that includes a movement mechanism, a needle bar mechanism, a processor, and a memory. The movement mechanism includes a motor configured to move a sewing object in a first direction and a second direction orthogonal to the first direction. The needle bar mechanism includes a needle bar to a lower end of which a sewing needle is detachably mounted. The needle bar mechanism is configured to drive the needle bar to reciprocate in an up-down direction. The memory is configured to store computer-readable instructions that, when executed by the processor, instruct the processor to perform processes. The processes include acquisition processing of acquiring coordinate data representing a position of each of a plurality of points along a predetermined pattern, corner portion detection processing of detecting, based on the coordinate data of each of the plurality of points, a corner portion, in the predetermined pattern, having an angle smaller than a predetermined angle, and editing processing of editing sewing data, based on the coordinate data of each of the plurality of points and on a detection result of the corner portion detection processing, using editing conditions that are mutually different for a plurality of first needle drop points corresponding to the corner portion and for a plurality of second needle drop points corresponding to a non-corner portion not detected as the corner portion, in the predetermined pattern. The sewing data is data for performing couching, using the sewing machine, to directly sew a cord member onto the sewing object, by forming a plurality of sewing stitches penetrating the cord member and the sewing object along the predetermined pattern. The processes also include sewing control processing of driving the movement mechanism and the needle bar mechanism in accordance with the sewing data edited at the editing processing, and performing the couching. The sewing machine is configured to edit the sewing data using the conditions that are different for the corner portion and for the non-corner portion in the pattern. According to the sewing machine, as a result of a user appropriately setting the editing conditions, in comparison to a case in which the editing conditions are the same for the corner portion and the non-corner portion of the predetermined pattern, the cord member is less likely to become detached from the sewing object at the corner portion, and the couching pattern having an attractive appearance can be obtained.

BRIEF DESCRIPTION OF THE DRAWINGS

Embodiments will be described below in detail with reference to the accompanying drawings in which.

DETAILED DESCRIPTION

Figure 1:
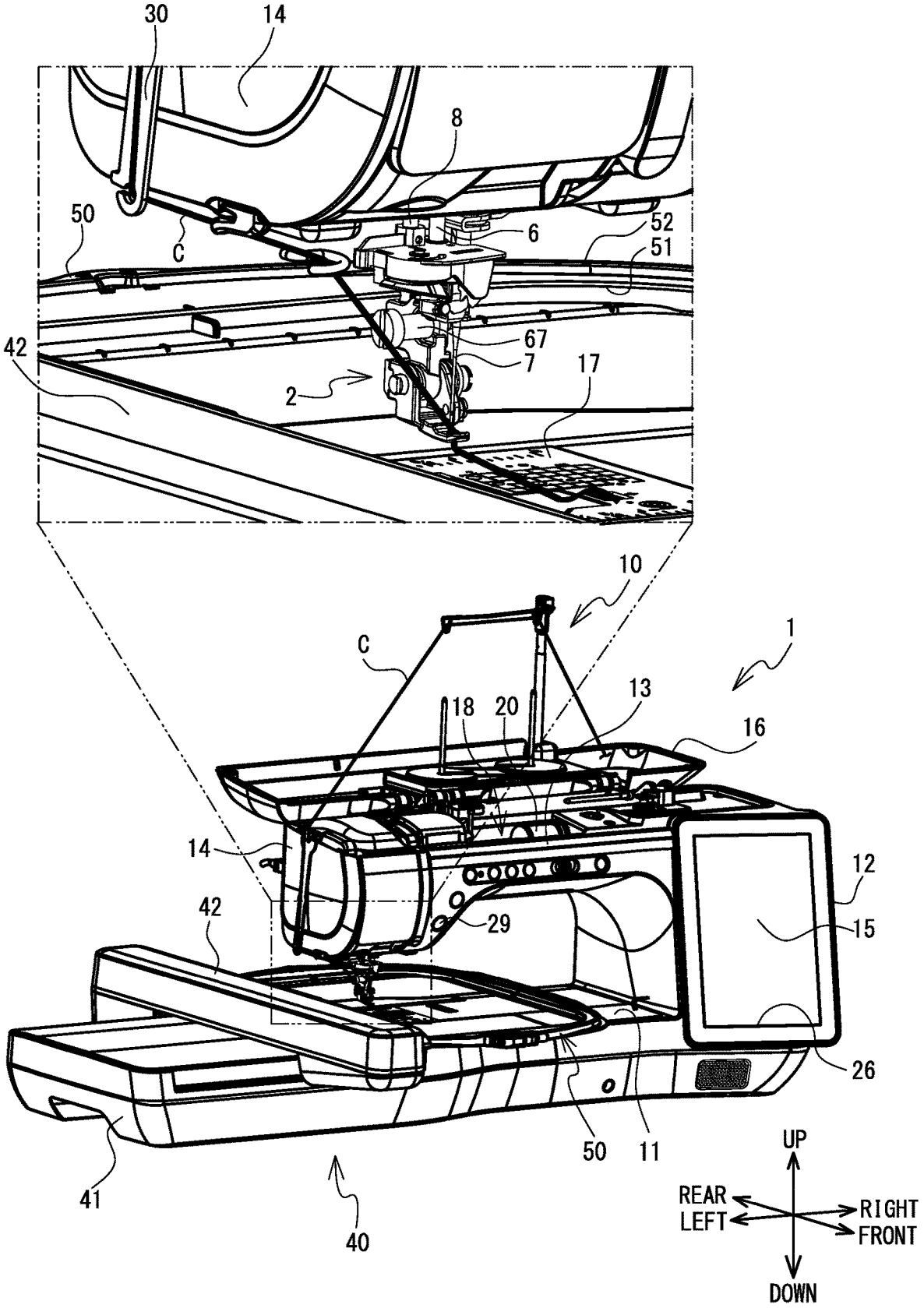
FIG. 1 is a perspective view of a sewing machine on which a presser device and a movement mechanism are mounted.

An embodiment of the present disclosure will be explained with reference to the drawings. A physical configuration of a sewing machine 1 on which a presser device 2 and a movement mechanism 40 are mounted will be explained with reference to FIG. 1. The up-down direction, the lower right side, the upper left side, the lower left side, and the upper right side of FIG. 1 respectively correspond to the up-down direction, the front side, the rear side, the left side, and the right side of the sewing machine 1 on which the presser device 2 and the movement mechanism 40 are mounted. The longitudinal direction of a bed portion 11 and an arm portion 13 is the left-right direction of the sewing machine 1, and the side on which a pillar 12 is disposed is the right side. The extending direction of the pillar 12 is the up-down direction of the sewing machine 1.

As shown in FIG. 1, the sewing machine 1 is provided with the bed portion 11, the pillar 12, the arm portion 13 and a head portion 14. The bed portion 11 is a base portion of the sewing machine 1 and extends in the left-right direction. The pillar 12 is provided so as to extend upward from the right end portion of the bed portion 11. The arm portion 13 faces the bed portion 11 and extends to the left from the upper end of the pillar 12. The head portion 14 is coupled to the left leading end portion of the arm portion 13.

Figure 3:
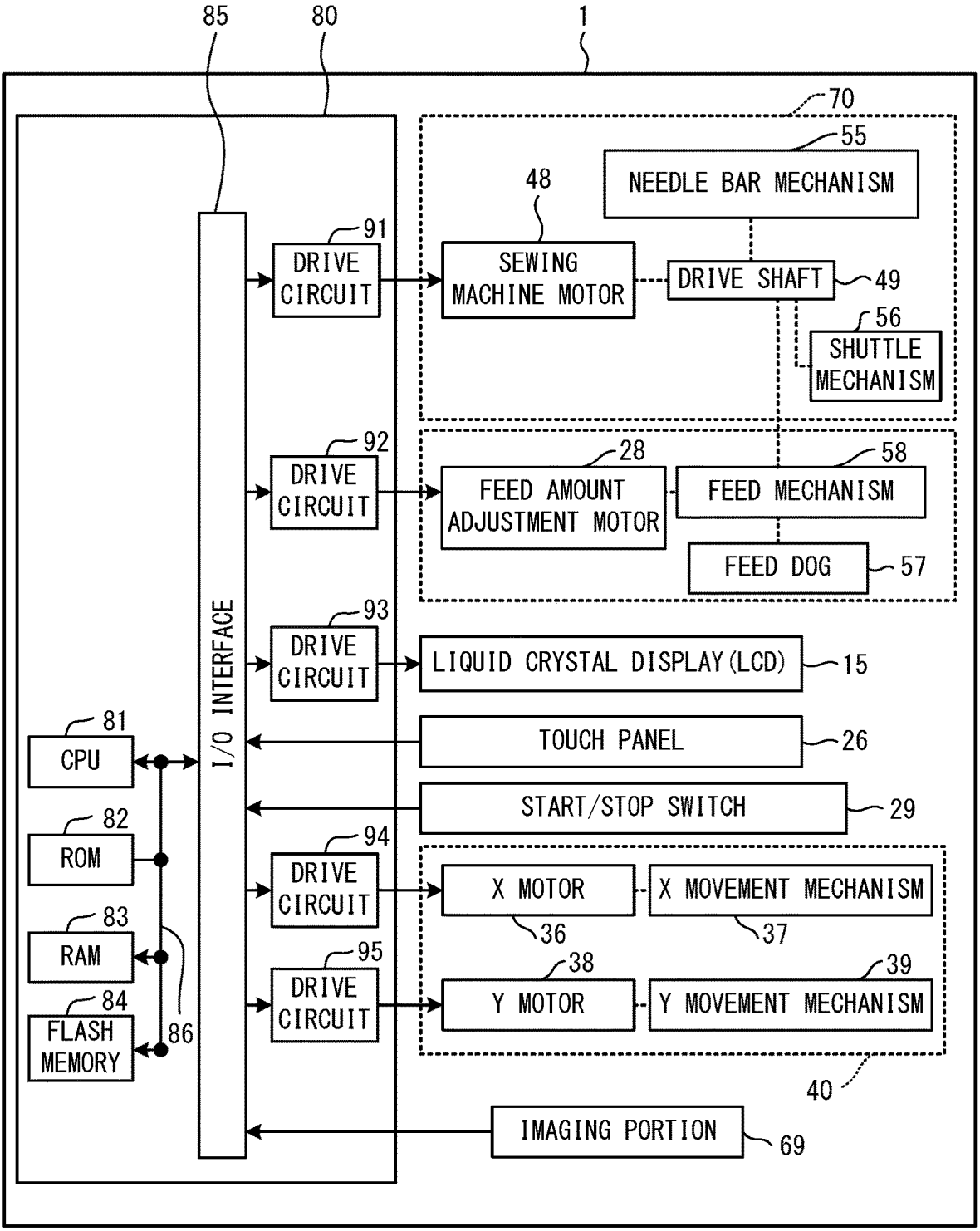
FIG. 3 is a block diagram showing an electrical configuration of the sewing machine.

A feed dog 57, a feed mechanism 58, a shuttle mechanism 56 and the like, which are shown in FIG. 3 are provided inside the bed portion 11 of the sewing machine 1. When normal sewing that is not embroidery sewing is performed, the feed dog 57 is configured to be driven by the feed mechanism 58 and moves a sewing object by a predetermined movement amount. The shuttle mechanism 56 entwines an upper thread (not shown in the drawings) with a lower thread (not shown in the drawings) below a needle plate 17 that is provided on an upper surface of the bed portion 11. Together with a sewing machine motor 48, a drive shaft 49, and a needle bar mechanism 55 to be described later, the shuttle mechanism 56 configures a sewing portion 70 configured to form stitches on the sewing object.

An LCD 15 is provided in the front surface of the pillar 12. The LCD 15 displays a screen including various items, such as commands, illustrations, setting values, messages, and the like. A touch panel 26, which is configured to detect a depressed position, is provided on the front surface side of the LCD 15. When a user of the sewing machine 1 performs a pressing operation on the touch panel 26, using a finger or a stylus pen (not shown in the drawings), the touch panel 26 detects the depressed position. A control portion 80 (refer to FIG. 3) of the sewing machine 1 detects a selected item on an image, on the basis of the detected depressed position. The sewing machine motor 48 is provided inside the pillar 12.

An upper portion of the arm portion 13 is provided with a cover 16 that is configured to open and close. FIG. 1 shows the sewing machine 1 when the cover 16 is in an open state. When the cover 16 is in a closed state, a thread housing portion 18 is provided below the cover 16 (namely, inside the arm portion 13). The thread housing portion 18 is configured to house a thread spool 20 around which the upper thread is wound. When the cover 16 is in the open state, a thread spool device 10 can be detachably mounted. The thread spool device 10 is configured to hold two thread spools, and is also configured to guide the upper thread supplied from each of the thread spools toward a sewing needle 7 of the sewing machine 1. When sewing a couching pattern, the thread spool device 10 is configured to guide a cord member C, such as wool or an ornamental cord, from a supply source (not shown in the drawings) of the cord member C toward the presser device 2. The supply source of the cord member C is, for example, a roll or the like on which the cord member C is wound, and the supply source is disposed to the right of the thread housing portion 18 when the cover 16 is in the open state, or in the vicinity of the sewing machine 1. The drive shaft 49 (refer to FIG. 3), which extends in the left-right direction, is provided inside the arm portion 13. The drive shaft 49 is configured to be driven to rotate by the sewing machine motor 48. Various switches, including a start/stop switch 29, are provided on a lower left portion of the front surface of the arm portion 13. The start/stop switch 29 starts or stops the operation of the sewing machine 1, namely, is used to input a sewing start command or a sewing stop command.

The head portion 14 is provided with a needle bar 6, the needle bar mechanism 55 (refer to FIG. 3), a presser bar 8, an imaging portion 69 (refer to FIG. 3), and the like. The needle bar 6 extends in the up-down direction. The sewing needle 7 is detachably mounted on the lower end of the needle bar 6. The needle bar mechanism 55 is configured to drive the needle bar 6 to reciprocate in the up-down direction as a result of the rotation of the drive shaft 49. The presser bar 8 extends in the up-down direction to the rear of the needle bar 6. The presser device 2 is detachably attached to the lower end portion of the presser bar 8. When embroidery sewing is performed using an embroidery frame 50, the presser device 2 intermittently presses the sewing object in synchronization with the up-down movement of the needle bar 6. The presser device 2 will be described in more detail later. The imaging portion 69 is provided inside the head portion 14. The imaging portion 69 is disposed so as to be able to capture a predetermined image capture range including a position below the needle bar 6, and is configured to generate image data obtained by capturing the image capture range. For the imaging portion 69, a coordinate system of an image represented by the image data generated by the imaging portion 69 (hereinafter also referred to as an "image coordinate system"), and a coordinate system of whole space (hereinafter also referred to as a "world coordinate system") are associated in advance using parameters stored in a flash memory 84 (refer to FIG. 3). The world coordinate system and an embroidery coordinate system are associated in advance, using parameters stored in the flash memory 84. The embroidery coordinate system will be described later. Thus, based on the image data generated by the imaging portion 69, the sewing machine 1 is configured to perform processing to generate a synthesized image in which formation positions of stitches represented by coordinates of the embroidery coordinate system are superimposed with the sewing object. When the cover 16 is in the open state, a guide member 30 is detachably mounted on the left side of the head portion 14. The guide member 30 extends in the up-down direction, and is configured to guide the cord member C toward the presser device 2.

The movement mechanism 40 is detachably mounted on the bed portion 11 of the sewing machine 1. The movement mechanism 40 is provided with a main body portion 41, a carriage 42, and a holder. An X movement mechanism 37 and an X motor 36 shown in FIG. 3 are provided inside the main body portion 41. The X movement mechanism 37 is configured to move the carriage 42 in the left-right direction (an X direction). The X motor 36 is configured to drive the X movement mechanism 37. The carriage 42 is configured to move in the left-right direction with respect to the main body portion 41. The carriage 42 is provided with a Y movement mechanism 39 and a Y motor 38 shown in FIG. 3. The Y movement mechanism 39 is configured to move the holder in the front-rear direction (a Y direction). The Y motor 38 is configured to drive the Y movement mechanism 39. The holder is supported, to the right of the carriage 42, so as to be able to move in the front-rear direction with respect to the carriage 42. The embroidery frame 50 configured to hold the sheet-shaped sewing object (a work cloth, for example) is detachably mounted on the holder. The embroidery frame 50 is provided with a first frame 51 and a second frame 52, and is configured to clamp the sewing object between the first frame 51 and the second frame 52. In the embroidery sewing using the embroidery frame 50, the movement mechanism 40 is configured to move the embroidery frame 50 mounted on the holder of the carriage 42 to a position indicated by a unique XY coordinate system (the embroidery coordinate system). In the embroidery coordinate system, for example, the right side, the left side, the rear side, and the front side of the sewing machine 1 are, respectively, a positive X direction, a negative X direction, a positive Y direction, and a negative Y direction.

Figure 2:
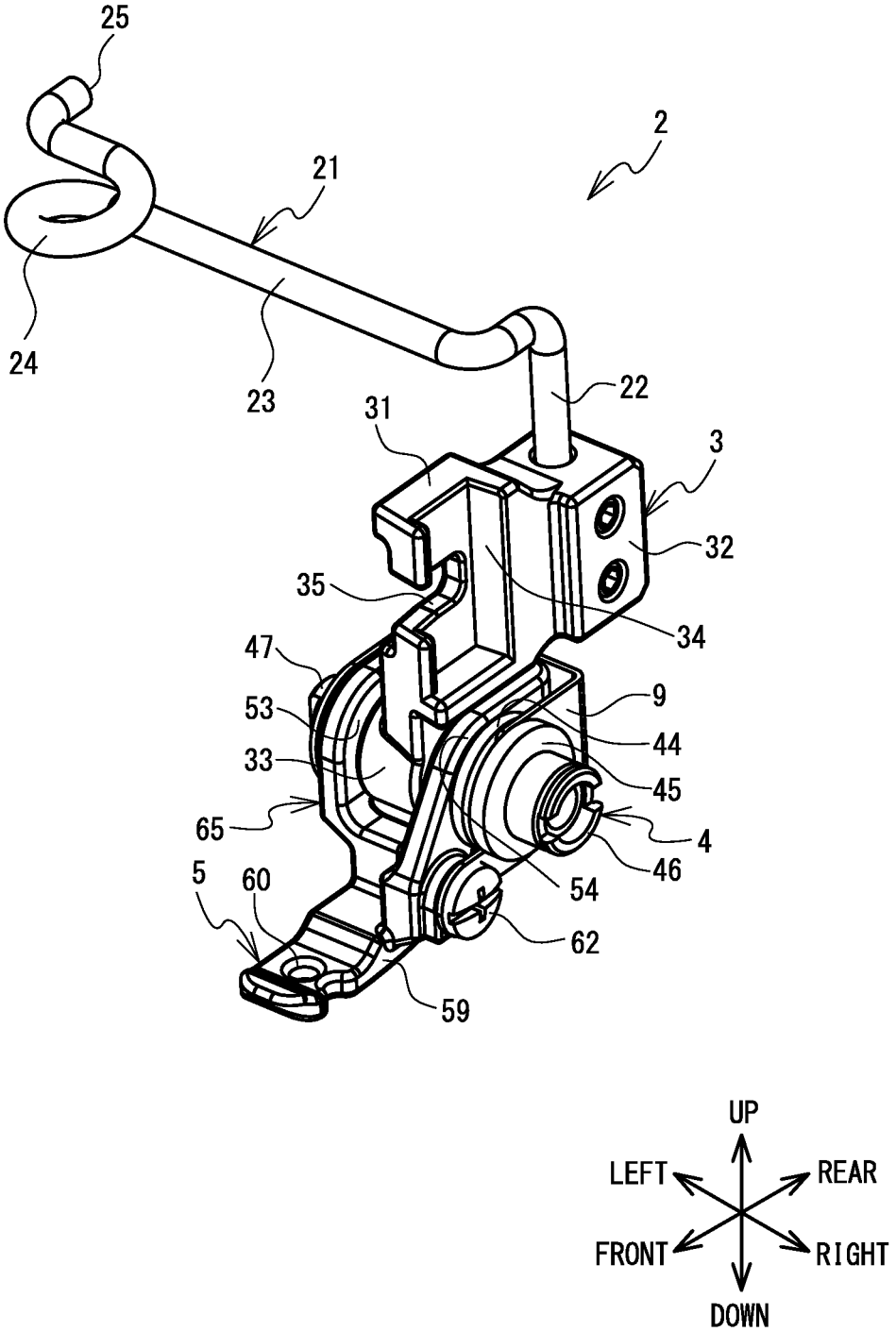
FIG. 2 is a perspective view of the presser device.

The presser device 2 will be explained with reference to FIG. 2. The presser device 2 is a metal presser device that is used when sewing the couching pattern using the embroidery frame 50 mounted on the movement mechanism 40. The presser device 2 is provided with an attachment body 3, an adjustment member 4, and a presser body 5. The presser device 2 is further provided with a suppression body 9 and a rotation stopper member (not shown in the drawings).

The attachment body 3 is provided with an attachment portion 31, support portions 32 and 33, a guide 21, and a shaft 47. The attachment portion 31 is attached to the presser bar 8 that is provided on the sewing machine 1 and that extends in the up-down direction. The attachment portion 31 extends in the up-down direction and includes recessed portions 34 and 35. The recessed portion 34 is a portion that is recessed to the left from a right end portion of the attachment portion 31. The recessed portion 34 extends to the upper end of the attachment portion 31. The recessed portion 35 is a portion that is recessed to the rear from a front end of the attachment portion 31, in the vicinity of substantially the center of the attachment portion 31 in the up-down direction. The recessed portion 35 is communicated with the recessed portion 34. In a state in which the presser bar 8 is disposed in the recessed portion 34, the presser device 2 is detachably mounted on the presser bar 8 by tightening a screw 67 (refer to FIG. 1) that is inserted through the recessed portion 35 and extends in the left-right direction into a screw hole formed in the presser bar 8. The support portion 32 is a cuboid shape that extends in the front-rear direction, to the rear of the attachment portion 31. The support portion 32 supports the guide 21, in a state in which the lower end of the guide 21 is inserted through a hole that is recessed downward from the upper end of the support portion 32.

With respect to an insertion hole 60 of the presser body 5 to be described later, the guide 21 is configured to guide the cord member C to the insertion hole 60 from the left. The guide 21 is a member formed by bending a rod shaped metal member, and is provided with a mounting portion 22, a support portion 23, and a loop portion 24. The mounting portion 22 extends in the up-down direction. The lower end of the mounting portion 22 is supported by the support portion 32. The support portion 23 is a portion that extends in the left-right direction. The loop portion 24 is a portion that is bent in a circular shape in the counterclockwise direction in a plan view from the right end of the loop portion 24. In the up-down direction, another end 25 of the loop portion 24 is positioned higher than the support portion 23. The loop portion 24 is positioned to the left and slightly to the rear of the insertion hole 60. When sewing the couching pattern, the cord member C is inserted through a hole surrounded by the loop portion 24. In a plan view, a length in the front-rear direction between the center of the circle surrounded by the loop portion 24 and the center of the insertion hole 60 of the presser body 5 is shorter than a length in the left-right direction between the center of the circle surrounded by the loop portion 24 and the center of the insertion hole 60 of the presser body 5. The shaft 47 is a rod-shaped member that extends in left-right direction intersecting the front-rear direction.

The adjustment member 4 is screwed together with the right end side of the shaft 47. In a state in which a relative position in the left-right direction between the presser body 5 and the adjustment member 4 is maintained at the same position, a relative position in the left-right direction between the shaft 47 of the attachment body 3 and the adjustment member 4 changes in accordance with the rotation of the adjustment member 4. The adjustment member 4 includes a first wall portion 44, a second wall portion 45, and an engagement portion 46. The adjustment member 4 engages with the suppression body 9 to be described later, between the first wall portion 44 and the second wall portion 45. The engagement portion 46 is provided on the right end of the adjustment member 4. The engagement portion 46 is disposed on the right side of the second wall portion 45, and has a groove that is configured to be engaged with a jig used to rotate the adjustment member 4.

The presser body 5 is configured to move along the shaft 47 in the left-right direction with respect to the attachment body 3, in accordance with the rotation of the adjustment member 4. The presser body 5 is provided with a mounting portion 65 and a presser portion 59. The mounting portion 65 is a portion used to mount the presser body 5 on the attachment body 3. The mounting portion 65 includes a left wall 53, a right wall 54, and a rear wall. The left wall 53 and the right wall 54 include insertion portions that penetrate in the left-right direction and through which the shaft 47 is inserted. In a state in which the shaft 47 is inserted through the insertion portions of the left wall 53 and the right wall 54, the support portion 33 of the attachment body 3 is disposed between the left wall 53 and the right wall 54.

The presser portion 59 extends to the front from the lower front side of the mounting portion 65. The presser portion 59 has the insertion hole 60. The insertion hole 60 is a through hole that is circular in a plan view and is provided in a front end portion of the presser portion 59. The sewing needle 7 mounted on the lower end of the needle bar 6, and the cord member C that has passed through the loop portion 24 of the guide 21 are inserted through the insertion hole 60. The position of the insertion hole 60 in the left-right direction with respect to the presser bar 8 (the attachment body 3) is configured to be adjusted using the adjustment member 4. The suppression body 9 comes into contact with the adjustment member 4 and suppresses the rotation of the adjustment member 4. The suppression body 9 engages with the adjustment member 4 between the first wall portion 44 and the second wall portion 45. The suppression body 9 is fixed to the presser body 5 using a screw 62. Specifically, the adjustment member 4 is rotatably fixed to the presser body 5 via the suppression body 9. A rotation stopper member is connected to the attachment body 3 and regulates the rotation of the presser body 5 around the shaft 47. The rotation stopper member is a pin that extends in the front-rear direction, and is connected to the attachment body 3 from the rear side of the attachment body 3.

An electrical configuration of the sewing machine 1 will be explained with reference to FIG. 3. The control portion 80 of the sewing machine 1 is provided with a CPU 81, a ROM 82, a RAM 83, the flash memory 84, an input/output (I/O) interface 85, and drive circuits 91 to 95. The CPU 81 is connected to the ROM 82, the RAM 83, the flash memory 84 and the I/O interface 85, via a bus 86.

The CPU 81 is configured to perform main control of the sewing machine 1, and is configured to perform various arithmetic computing and processing related to sewing, in accordance with various programs stored in the ROM 82. Although not shown in the drawings, the ROM 82 is provided with a plurality of storage areas including a program storage area. The various programs (a program for executing main processing to be described later, for example) that are used to operate the sewing machine 1 are stored in the program storage area. A storage area for storing computation results and the like resulting from the arithmetic processing is provided in the RAM 83. Various parameters and the like used by the sewing machine 1 to perform various processing are stored in the flash memory 84. The drive circuits 91 to 95, the touch panel 26, the start/stop switch 29, and the imaging portion 69 are connected to the I/O interface 85.

The sewing machine motor 48 is connected to the drive circuit 91. The drive circuit 91 is configured to drive the sewing machine motor 48 in accordance with a control signal from the CPU 81. The needle bar mechanism 55 is configured to be driven via the drive shaft 49 of the sewing machine 1 in accordance with the driving of the sewing machine motor 48, and the needle bar 6 moves up and down. A feed amount adjustment motor 28 is connected to the drive circuit 92. By driving the liquid crystal display (LCD) 15 in accordance with a control signal from the CPU 81, the drive circuit 93 is configured to cause an image to be displayed on the LCD 15. The X motor 36 is connected to the drive circuit 94. The Y motor 38 is connected to the drive circuit 95. The drive circuits 94 and 95 respectively are configured to drive the X motor 36 and the Y motor 38 in accordance with control signals from the CPU 81. In accordance with the driving of the X motor 36 and the Y motor 38, the embroidery frame 50 mounted on the movement mechanism 40 moves in the left-right direction (the X direction) and the front-rear direction (the Y direction) by a movement amount depending on the control signal.

An example of an operation when the couching pattern is sewn by the sewing machine 1 on which the presser device 2 and the movement mechanism 40 are mounted will be explained with reference to FIG. 1 to FIG. 3. The user mounts the upper thread and the lower thread on the sewing machine 1 in the same manner as for normal embroidery sewing. The user mounts the embroidery frame 50 holding the sewing object on the movement mechanism 40. The user attaches the presser device 2 to the presser bar 8. Using the jig, the user rotates the adjustment member 4 around a rotation axis extending in the left-right direction, and thus adjusts the position of the insertion hole 60 with respect to the presser bar 8 in the left-right direction. The user hooks the cord member C on the thread spool device 10, the guide member 30, and the loop portion 24, and passes the cord member C through the insertion hole 60 from above. After selecting sewing data for sewing the couching pattern, the user inputs the sewing start command by selecting the start/stop switch 29. When the sewing start command is acquired, the control portion 80 of the sewing machine 1 drives the movement mechanism 40 and the sewing portion 70 in accordance with the sewing data, and forms the couching pattern on the sewing object by stitching the cord member C onto the sewing object.

The main processing performed when performing couching using the sewing machine 1 will be explained using first and second specific examples of sewing a star-shaped pattern J, with reference to FIG. 4 to FIG. 10. In the main processing, processing is performed to edit sewing data based on coordinate data of the sewing data selected by the user, or on coordinate data of a graphic specified by the user, and to sew a pattern on the sewing object held by the embroidery frame 50, based on the edited sewing data. The first specific example is an example in which the user operates the touch panel 26 and specifies positions of apexes that define a shape of the pattern J, and the second specific example is an example in which the user operates the touch panel 26 and specifies the sewing data of the pattern J from among a plurality of the sewing data stored in the flash memory 84. The main processing is activated when the user inputs a command to start the processing. When the control portion 80 detects the command to start the processing, the program for executing the main processing that is stored in the program storage area of the ROM 82 is read out from the RAM 83. The control portion 80 performs each of steps below, in accordance with commands included in the program read out from the RAM 83. Various parameters necessary for executing the main processing are stored in the flash memory 84. Various data obtained in the course of the main processing are stored as necessary in the RAM 83. The left-right direction and the up-down direction shown in FIG. 5 and FIG. 7 correspond, respectively, to the X direction and the Y direction of the embroidery coordinate system. At the start of the main processing, the embroidery frame 50 holding the sewing object is mounted to the movement mechanism 40.

Figure 4:
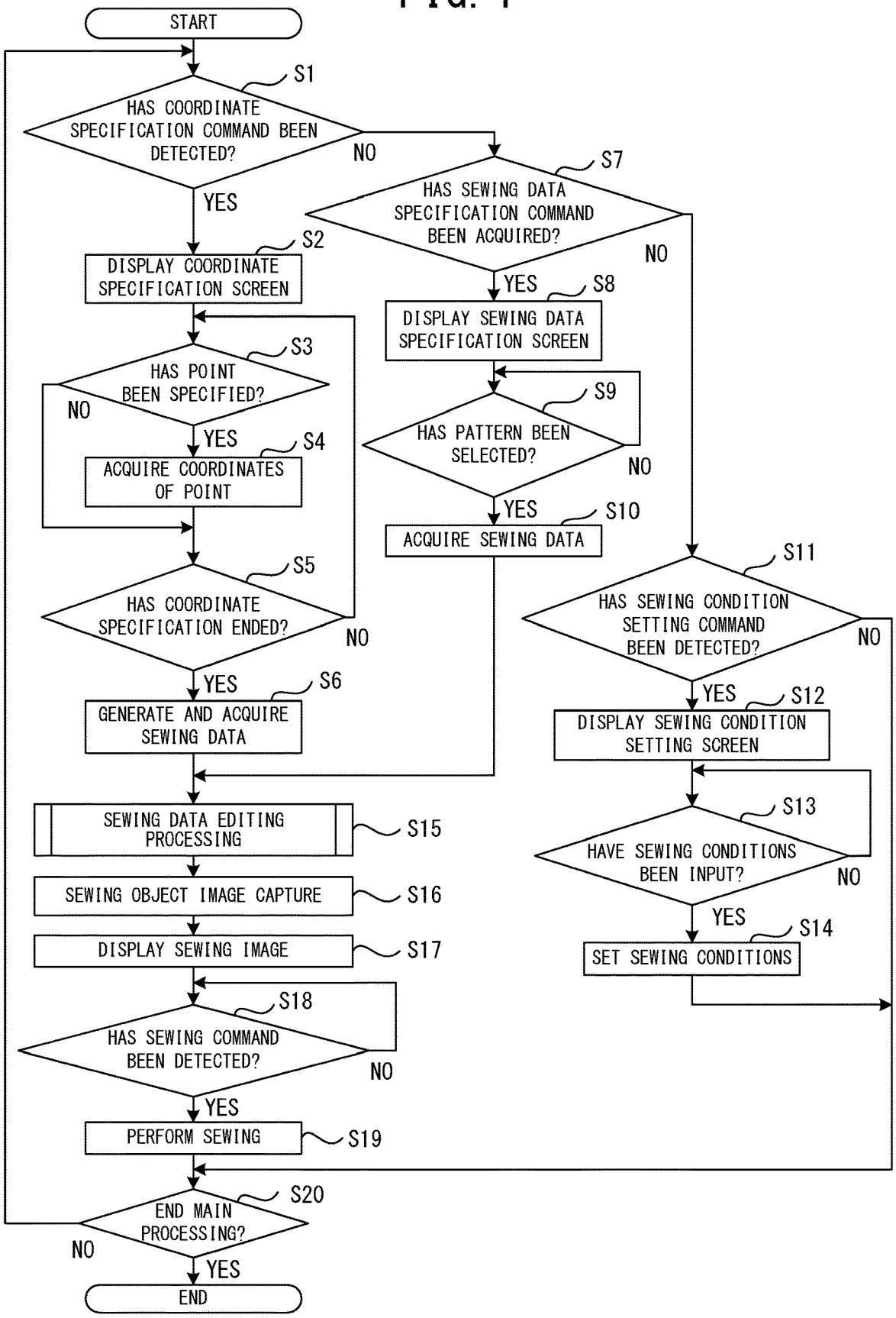
FIG. 4 is a flowchart of main processing.
Figure 5:
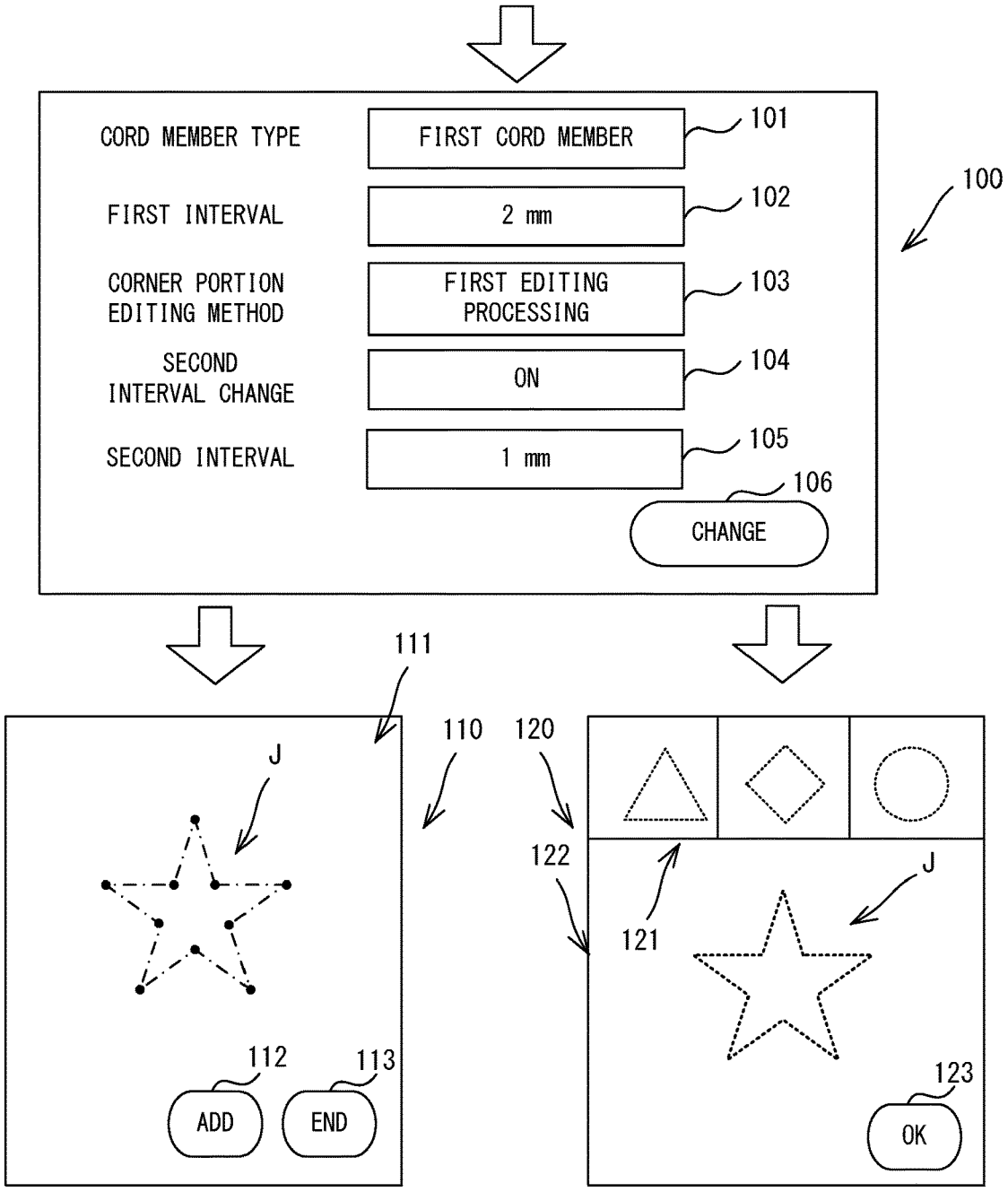
FIG. 5 is an explanatory diagram of a table and a screen referred to in the main processing.

As shown in FIG. 4, the control portion 80 determines whether a coordinate specification command has been detected, on the basis of an output of the touch panel 26 (step S1). When specifying a shape of a pattern formed by the couching, the user operates the touch panel 26 to input the coordinate specification command. When the coordinate specification command has not been detected (no at step S1), the control portion 80 determines whether a sewing data specification command has been acquired (step S7). When selecting the sewing data used in the couching, from among the sewing data stored in the sewing machine 1, the user operates the touch panel 26 and inputs the sewing data specification command. When the sewing data specification command has not been detected (no at step S7), the control portion 80 detects whether a sewing condition setting command has been detected (step S11). When specifying sewing conditions used when performing the couching, the user operates the touch panel 26 and inputs the sewing condition setting command. When the sewing condition setting command has not been detected (no at step S11), the control portion 80 performs processing at step S20 to be described later.

When the sewing condition setting command has been detected (yes at step S11), the control portion 80 refers to a table 87 and displays, on the LCD 15, a screen 100 used in setting the sewing conditions (step S12). The table 87 stores a type, a thickness, a softness, a second interval K2, and the like of the cord member C that is used in the couching, in association with each other. It is sufficient that an evaluation method of the softness of the cord member C is established in advance, and is represented by an evaluation value that uses an integer. The screen 100 includes fields 101 to 105, and a key 106. The sewing machine 1 of a present embodiment is configured to set, as the sewing conditions when performing the couching, a type of the cord member C, a first interval K1, a corner portion editing method, a presence/absence of a second interval change, and the second interval K2. The field 101 displays the type of the cord member C. The type of the cord member C is categorized by a material, the thickness, the softness, and the like. The material of the cord member C is, for example, wool, the ribbon, the ornamental cord, and the like. The softness is, for example, the evaluation value represented by the integer. The field 102 displays, as the first interval K1, a feed amount when sewing a non-corner portion, which is a portion other than the corner portion. Of the pattern, the sewing machine 1 of the present embodiment detects a portion having an acute angle as the corner portion. A range of the corner portion may be set as appropriate, taking into account the type of the cord member C and the like, and the corner portion of the present embodiment is a portion of several stitches adjacent to the acute angle.

The field 103 displays the angle portion editing method that is set for editing the sewing data using editing conditions that are mutually different for a plurality of first needle drop points corresponding to the angle portion and for a plurality of second needle drop points corresponding to the non-corner portions that are not detected as the corner portions. The needle drop point is represented by the sewing data, and is a predetermined point at which the sewing needle 7 pierces the sewing object. In the sewing machine 1 of the present embodiment, one of a first editing method, a second editing method, or a third editing method can be selected as the corner portion editing method. The first editing method is a method that edits the sewing data such that, of the plurality of first needle drop points, an interval between two of the first needle drop points that are consecutive in a sewing order is the second interval K2 that is shorter than the first interval K1 of the non-corner portions. The second editing method is a method that sets one or more needle drop points inside a triangular shape obtained by connecting a target point that is the corner portion with two points adjacent to the target point, and edits the sewing data that forms a plurality of sewing stitches separated from the target point. The third editing method is a method that edits the sewing data in which, of a plurality of points, the sewing order of two points adjacent to the target point, which is the corner portion, is switched.

The field 104 sets whether or not to change the feed amount between the corner portion and the non-corner portion. In the sewing machine 1, when the feed amount of the corner portion is to be a value smaller than the feed amount of the non-corner portion, the second interval change is set to ON, and when the feed amount of the corner portion is to be the same as the feed amount of the non-corner portion, the second interval change is set to OFF. The field 105 displays, as the second interval K2, the feed amount to be used when sewing the corner portion when the second interval change is ON. The key 106 is used to input a command to confirm a change.

The control portion 80 determines whether the sewing conditions have been input by determining whether the selection of the key 106 has been detected (step S13). After setting the sewing conditions as appropriate in the fields 101 to 105, the user selects the key 106 using the touch panel 26. When the selection of the key 106 has not been detected (no at step S13), the control portion 80 stands by until the key 106 is selected. When the selection of the key 106 has been detected (yes at step S13), the control portion 80 stores each of the sewing conditions of the fields 101 to 105 in the flash memory 84, and sets the sewing conditions (step S14). The control portion 80 performs the processing at step S20 to be described below.

In the first specific example, the coordinate specification command is detected (yes at step S1), and the control portion 80 displays, on the LCD 15, a screen 110 for specifying the position of the apex of the pattern J (step S2). The screen 110 includes a field 111, and keys 112 and 113. The field 111 displays the pattern J in which points specified by the user operating the touch panel 26 are joined in an input order. The key 112 inputs a command to add a point to the field 111. The key 113 inputs a command to end the processing of adding the points to the field 111. After specifying the position of the point by operating the touch panel 26, and after repeating the operation of selecting the key 112 a plurality of times, the user selects the key 113. After the user has specified the position of the point, on the basis of an output of the touch panel 26, the control portion 80 determines whether the operation to select the key 112 has been detected (step S3). After the specification of the position of the point, when the operation to select the key 112 has been detected (yes at step S3), the control portion 80 acquires coordinates of the detected point, and stores the coordinates of the point and an acquisition order (step S4). By repeating step S4 a plurality of times, the control portion 80 acquires coordinate data of each of the plurality of points specified as desired on the LCD 15 by the user, via the touch panel 26. After specifying the position of the point, when the operation selecting the key 112 has not been detected (no at step S3), or after step S4, the control portion 80 determines whether the selection of the key 113 has been detected (step S5). When the selection of the key 113 has not been detected (no at step S5), the control portion 80 returns the processing to step S3. When the selection of the key 113 has been detected (yes at step S5), on the basis of the coordinate data of the plurality of points acquired by the processing at step S4, the control portion 80 generates the sewing data for sewing, using running stitches at a predetermined feed amount, a graphic obtained by linking the plurality of points in the acquisition order by straight lines, and acquires the generated sewing data (step S6). The sewing data includes the coordinate data, represented using the embroidery coordinate system, of each of the plurality of needle drop points.

Figure 7:
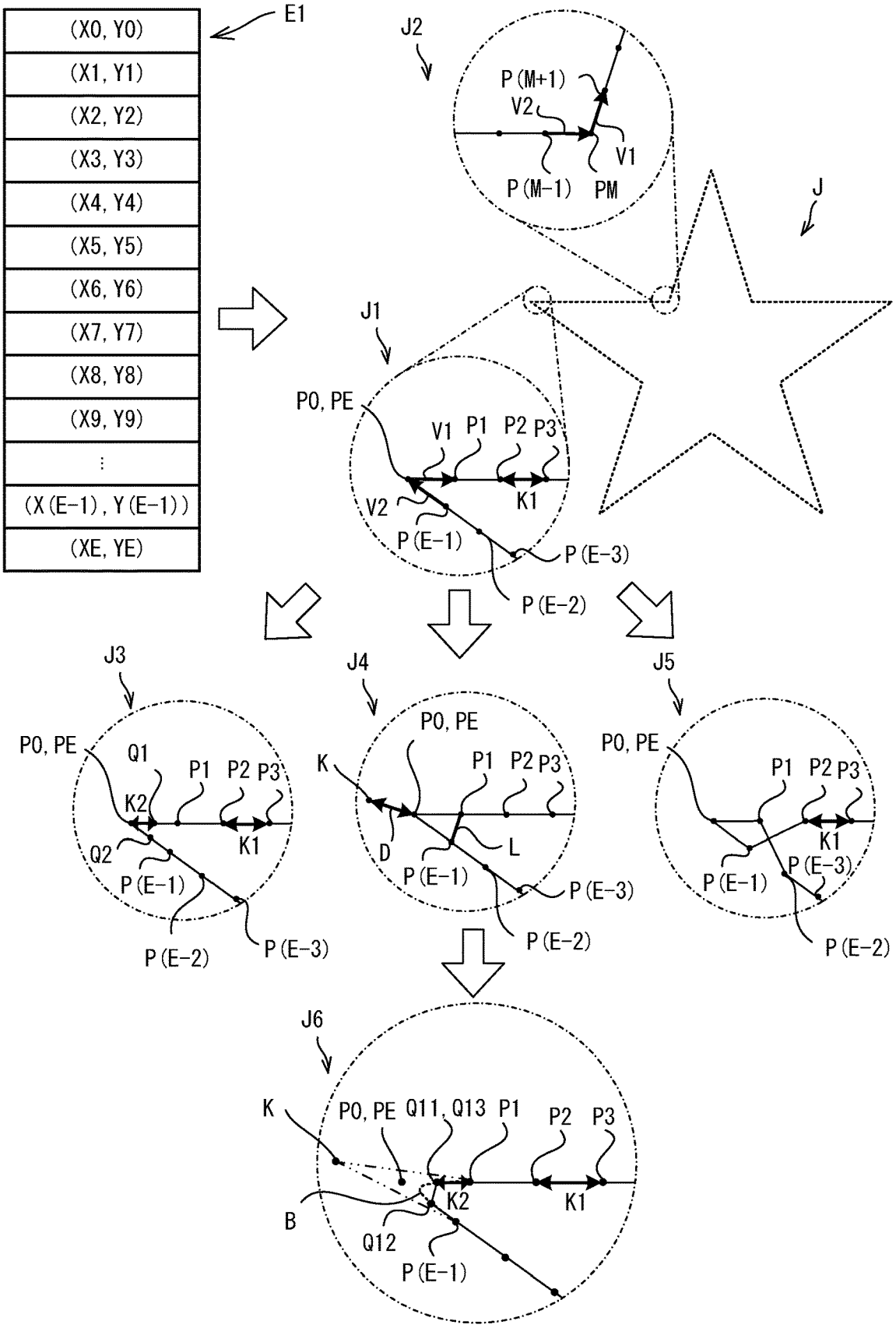
FIG. 7 is an explanatory diagram of a process in which sewing data of a pattern is edited by the sewing data editing processing shown in FIG. 6.

In the second specific example, the sewing data specification command is detected (yes at step S7), and the control portion 80 displays, on the LCD 15, a screen 120 for specifying the sewing data (step S8). The screen 120 includes fields 121 and 122, and a key 123. The field 121 displays an image of a plurality of patterns. The image of each of the patterns is represented based on the sewing data stored in the flash memory 84. The field 122 displays an image of one pattern that has been selected from among the plurality of patterns displayed in the field 121. The key 123 inputs a command to confirm the selection of the pattern displayed in the field 122. After using the touch panel 26 to select the one pattern from among the plurality of patterns displayed in the field 121, the user selects the key 123. The control portion 80 determines whether the selection of the key 123 has been detected (step S9). The control portion 80 stands by until the selection of the key 123 is detected (no at step S9). When the selection of the key 123 has been detected (yes at step S9), the control portion 80 refers to the flash memory 84, and acquires the sewing data of the pattern J displayed in the field 122 (step S10). In order to simplify the explanation, an explanation will be given in which the sewing data of the first specific example generated at step S6, and the sewing data of the second specific example acquired at step S10 are both sewing data E1. As shown in FIG. 7, the sewing data E1 includes coordinate data showing positions of needle drop points sewn using running stitch. Each of the plurality of needle drop points is disposed at the first interval K1 along the pattern J. When performing the couching using the sewing data, the sewing stitches formed in accordance with the sewing data are formed substantially in the center, in a width direction, of the cord member C.

After step S6 or step S10, the control portion 80 performs sewing data editing processing (step S15). The sewing data editing processing is processing that edits the sewing data, based on each of the coordinate data of the plurality of needle drop points included in the sewing data and on the detection result of the corner portions, using mutually different editing conditions, for the plurality of first needle drop points corresponding to the corner portions and for the plurality of second needle drop points corresponding to the non-corner portions at which the corner portions are not detected, in the pattern J. The control portion 80 edits the sewing data acquired at step S6 or step S10, based on the coordinate data of each of the plurality of needle drop points and on the detection result of the corner portions.

Figure 6:
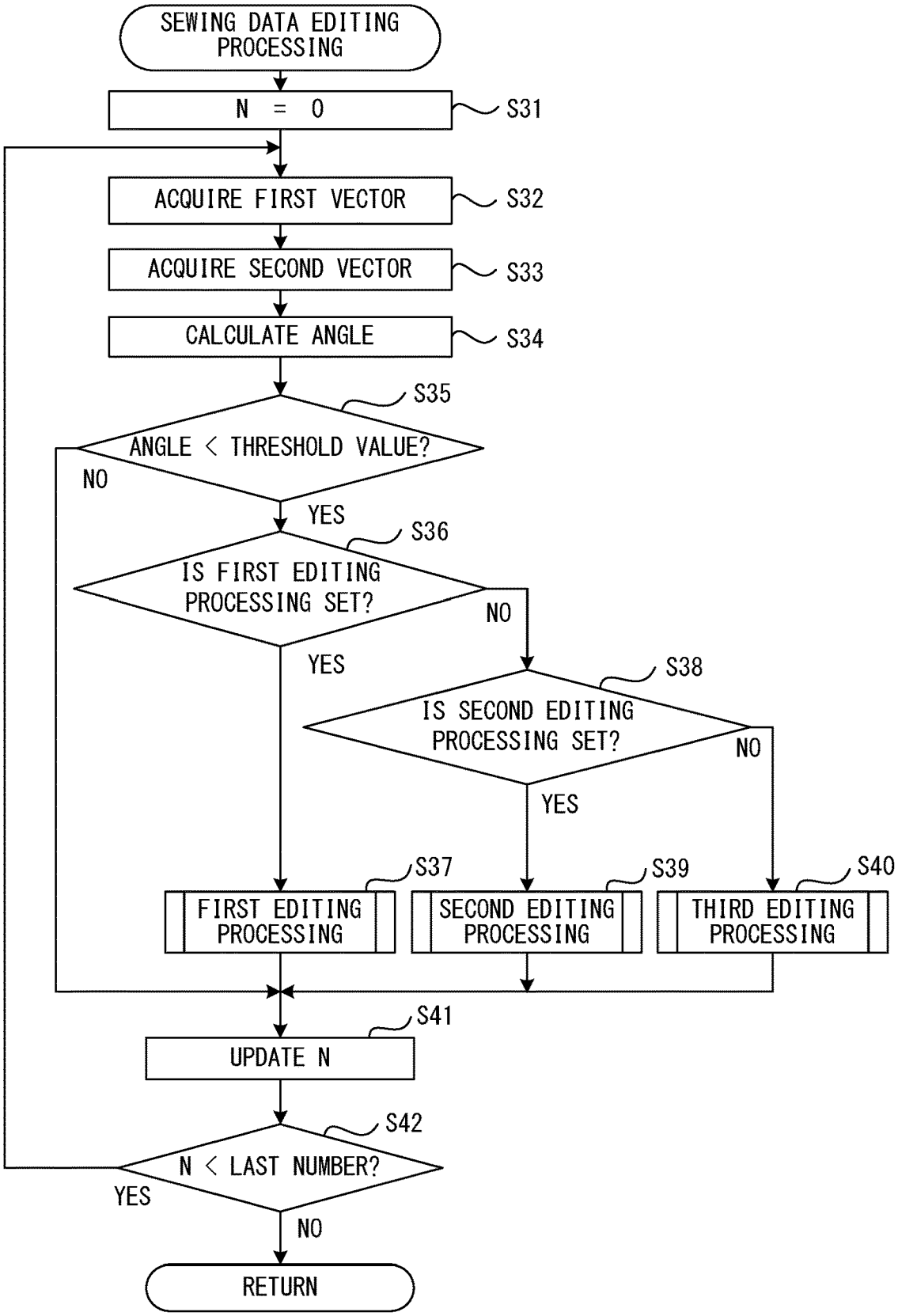
FIG. 6 is a flowchart of sewing data editing processing performed in the main processing shown in FIG. 4.

As shown in FIG. 6, the control portion 80 sets a variable N, which is used for reading out a sewing order of the coordinate data included in the sewing data, to zero (step S31). The control portion 80 acquires a first vector V1 (step S32). The first vector V1 is a vector from a needle drop point PN that is N-th in the sewing order toward a needle drop point P(N+1) that is (N+1)-th in the sewing order. As shown by a section J1 in FIG. 7, when the variable N is zero, the first vector V1 is acquired from a 0-th needle drop point P0 toward a first needle drop point P1. The control portion 80 acquires a second vector V2 (step S33). The second vector V2 is a vector from an (N−1)-th needle drop point P(N−1) toward the N-th needle drop point PN. When the variable N is zero, and when coordinates of the needle drop point P0 (X0, Y0) when the variable N is zero match coordinates of a needle drop point PE (XE, YE) when the variable N is a number E that is the last number in the sewing order, the second vector V2 is obtained from an (E−1)-th needle drop point (E−1) toward the 0-th (E-th) needle drop point P0 (the point PE). When the coordinates (X0, Y0) of the point P0 and the coordinates (XE, YE) of the point PE do not match each other, the second vector V2 is not acquired, and after the processing at step S33, processing at step S41 may be performed.

The control portion 80 calculates an angle formed between the first vector V1 acquired at step S32 and the second vector V2 acquired at step S33 (step S34), and determines whether the calculated angle is smaller than a threshold value (step S35). Step S35 is processing for detecting the corner portions that are smaller than the threshold value (a predetermined angle), in the pattern J, based on the coordinate data of each of the plurality of points. It is sufficient that the threshold value be set in advance, and the threshold value of the present embodiment is smaller than 90 degrees. In other words, of the pattern J, the control portion 80 of the present embodiment detects a portion as the corner portion when the angle formed between the first vector V1 and the second vector V2 is an acute angle.

When the variable N is 0, when the angle calculated at step S34 is determined to be smaller than the threshold value (yes at step S35), the control portion 80 refers to the flash memory 84 and determines whether first editing processing is set as the corner portion editing method (step S36). When the first editing processing is set as the corner portion editing method (yes at step S36), the control portion 80 performs the first editing processing (step S37). In the first editing processing, the control portion 80 edits the sewing data based on the coordinate data of each of the plurality of needle drop points and on the detection result of the corner portion at step S35, such that, in the pattern J, the interval between two of the first needle drop points that are consecutive in the sewing order, of the plurality of first needle drop points, is the second interval K2 that is shorter than the first interval K1.

Figure 8:
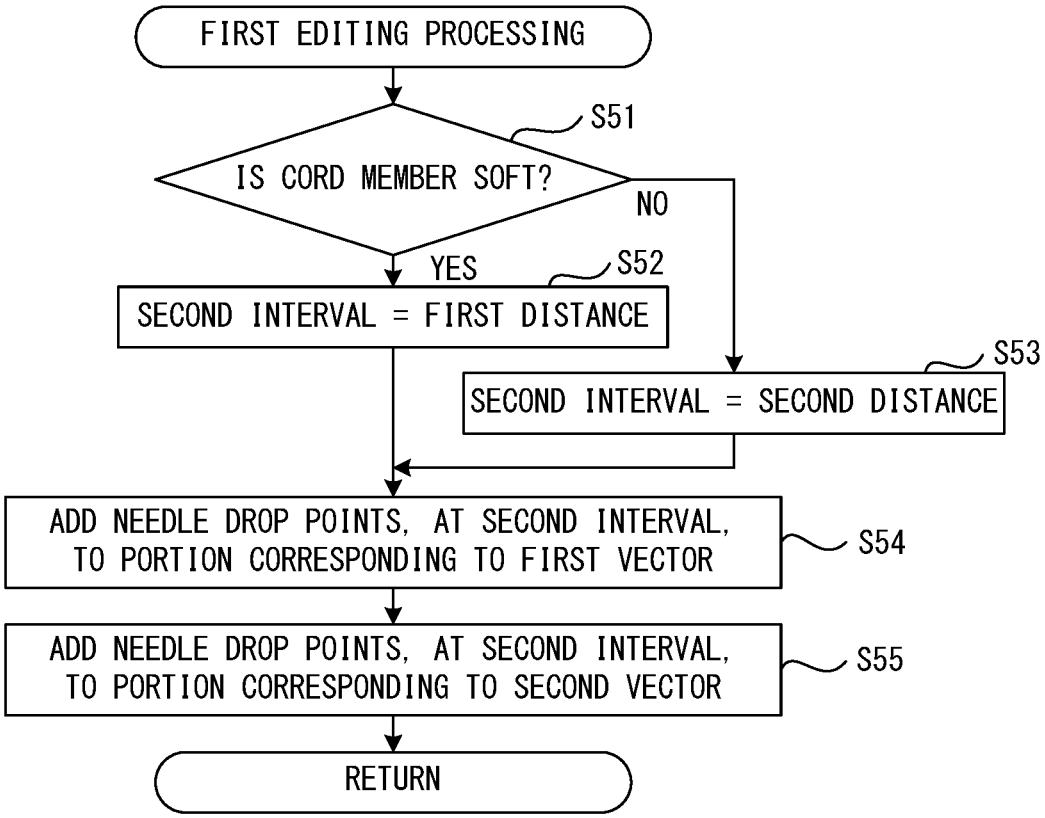
FIG. 8 is a flowchart of first editing processing performed in the sewing data editing processing shown in FIG. 6.

As shown in FIG. 8, the control portion 80 refers to the sewing conditions stored in the flash memory 84, and, based on the type of the cord member C, determines whether the cord member C is soft (step S51). A method of determining whether the cord member C is soft may be set as appropriate. When the softness of the cord member C is set as an evaluation value, for example, the control portion 80 may determine that the cord member C is soft when the evaluation value is larger than a threshold value. When the cord member C is soft (yes at step S51), the control portion 80 sets a first distance as the second interval K2 (step S52). When the cord member C is not soft (no at step S51), the control portion 80 sets a second distance, which is longer than the first distance, as the second interval K2 (step S53). Each of the first distance and the second distance may be set in accordance with the first interval K1, or may be set as predetermined values, regardless of the first interval K1. In the sewing machine 1 of the present embodiment, when the first interval K1 is 2 mm, the first distance is set to 0.5 mm, for example, which is ¼ the length of the first interval K1, and the second distance is set to 1 mm, for example, which is half the length of the first interval K1.

After step S52 or step S53, the control portion 80 adds one or more needle drop points Q1, to a portion corresponding to the first vector V1 acquired at step S32, at the second interval K2 set at step S52 or step S53 (step S54). The control portion 80 adds one or more needle drop points Q2, to a portion corresponding to the second vector V2 acquired at step S33, at the second interval K2 set at step S52 or step S53 (step S55). In a section J3 shown in FIG. 7, the point P0, the point Q1, the point P1, the point P(E−1), the point Q2, and the point PE are examples of the plurality of first needle drop points corresponding to the corner portion, and a point P2, a point P3, a point P(E−3), and a point P(E−2) are examples of the plurality of second needle drop points corresponding to the non-corner portion. The control portion 80 here ends the first editing processing, and returns the processing to the sewing data editing processing shown in FIG. 6.

When second editing processing is set as the corner portion editing method (no at step S36; yes at step S38), the control portion 80 performs the second editing processing (step S39). In the second editing processing, based on the coordinate data of each of the plurality of points and on the detection result of the corner portion at step S35, the control portion 80 sets one or more needle drop points inside a triangular shape obtained by connecting, of the plurality of needle drop points, the three points used in the process of step S2, that is to say, the target point PN, and two points P(N+1) and P(N−1) that are adjacent to the target point PN, and edits the sewing data to the sewing data that forms the plurality of sewing stitches separated from the target point PN.

Figure 9:
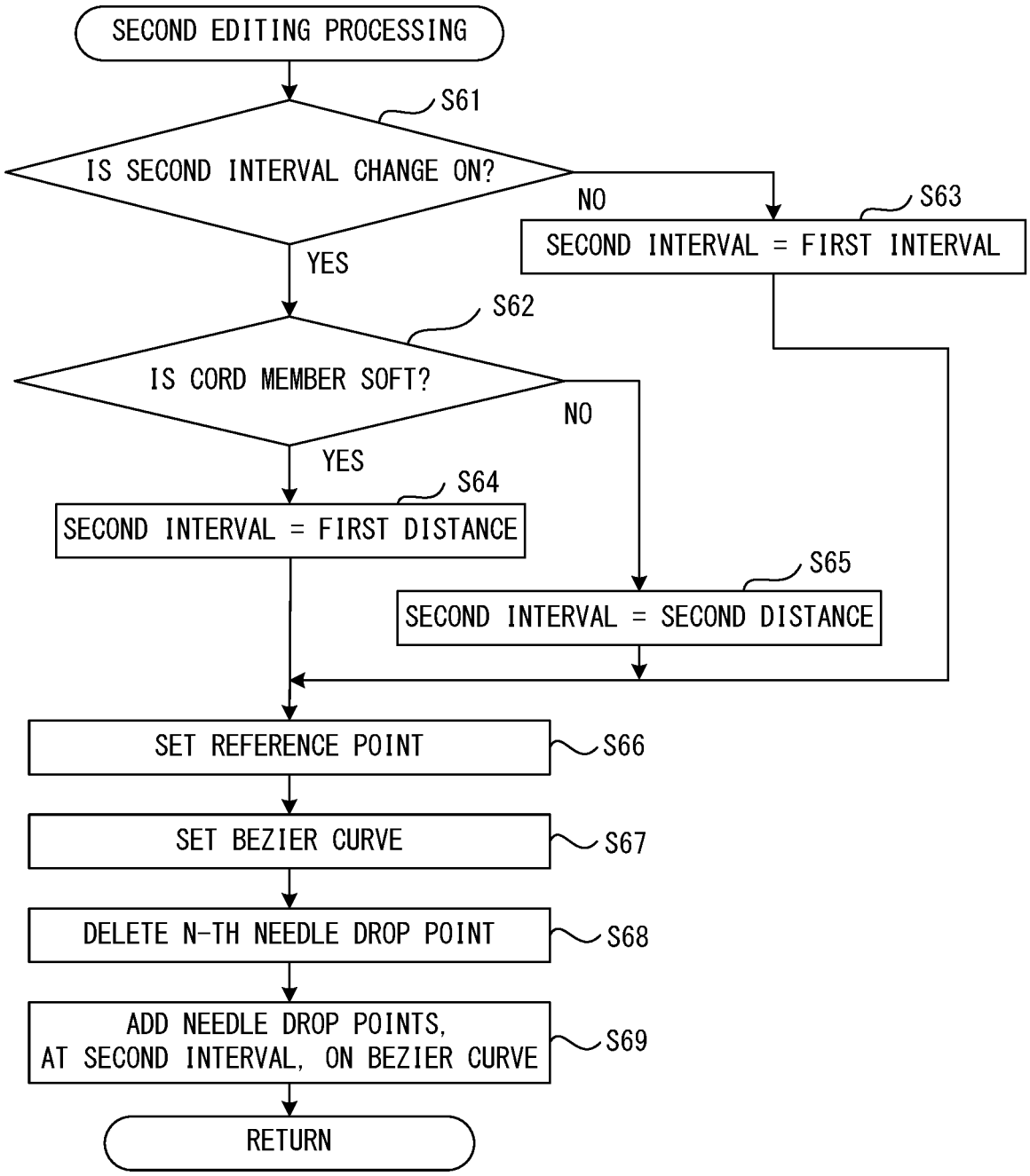
FIG. 9 is a flowchart of second editing processing performed in the sewing data editing processing shown in FIG. 6.

As shown in FIG. 9, the control portion 80 refers to the sewing conditions stored in the flash memory 84 and determines whether the second interval change is set to ON (step S61). When the second interval change is set to ON (yes at step S61), based on the coordinate data of each of the plurality of points and on the detection result of the corner portion at step S35, the control portion 80 edits the sewing data such that, in the pattern J, the interval between two of the first needle drop points that are consecutive in the sewing order, of the plurality of first needle drop points, is the second interval K2 that is shorter than the first interval K1. Specifically, in a similar manner to the processing at step S51, based on the type of the cord member C, the control portion 80 determines whether the cord member C is soft (step S62). When the cord member C is soft (yes at step S62), the control portion 80 sets the first distance as the second interval K2 (step S64). When the cord member C is not soft (no at step S62), the control portion 80 sets the second distance that is longer than the first distance, as the second interval K2 (step S65). When the second interval change is set to OFF (no at step S61), the control portion 80 sets the first interval K1 as the second interval K2 (step S63).

After step S63, step S64, or step S65, the control portion 80 sets a reference point K based on the target point PN (step S66). The control portion 80 takes the N-th needle drop point as the target point PN, and sets a line segment L, which is a line segment connecting the two points adjacent to the target point PN, namely, connecting the (N+1)-th needle drop point P(N+1) and the (N−1)-th needle drop point P(N−1). The control portion 80 sets, as the reference point K, a point that, of the points on a line segment that passes through the target point PN and that is perpendicular to the line segment L, is on the opposite side from the side of the line segment L with respect to the point PN, and for which a distance from the point PN is a predetermined distance (2 mm, for example). The predetermined distance may be set as appropriate, and may be a constant value regardless of the first interval K1, or may be a value that depends on the first interval K1. As shown by a section J4 in FIG. 7, when the variable N is zero, and when the needle drop point P0 and the needle drop point PE that is last in the sewing order are the same coordinates when the variable N is zero, the line segment L is a line segment connecting the point P(E−1) and the point P1.

Based on the reference point K set at step S66, the needle drop point P(N+1), and the needle drop point P(N−1), the control portion 80 sets a Bezier curve B (step S67). A method of setting the Bezier curve B is a known method and an explanation thereof is omitted here. The control portion 80 deletes the N-th needle drop point PN from the sewing data (step S68), and adds needle drop points on the Bezier curve B set at step S67, at the second interval K2 set at either step S63 or step S65 (step S69). By the processing at step S68 and step S69, the one or more needle drop points are set on the inside of the triangular shape formed by connecting the target point PN, and the two points P(N+1) and P(N−1) adjacent to the target point PN, and the sewing data is edited to the sewing data that forms the plurality of sewing stitches separated from the target point PN. As shown by a section J6 in FIG. 7, when the variable N is zero, points Q11 to Q13 are set, and the sewing data is edited to the sewing data that forms the plurality of sewing stitches separated from the target point. All of angles formed between a line segment connecting the point Q11 and the point P1, a line segment connecting the point P(E−1) and the point Q12, and a line segment connecting the point Q12 and the point Q13 are larger than the angle of the target point PN calculated at step S34. In the section J6 shown in FIG. 7, the point P1, the points Q11 to Q13, and the point P(E−1) are examples of the plurality of first needle drop points corresponding to the corner portion, and the point P2, the point P3, the point P(E−3), and the point P(E−2) are all examples of the plurality of second needle drop points corresponding to the non-corner portion. The control portion 80 here ends the second editing processing, and returns the processing to the sewing data editing processing shown in FIG. 6.

When third editing processing is set as the corner portion editing method (no at step S36; no at step S38), the control portion 80 performs the third editing processing (step S40). In the third editing processing, based on the coordinate data of each of the plurality of points and on the detection result of the corner portion at step S35, the control portion 80 edits the sewing data in which, of the plurality of needle drop points, the sewing order of the two points P(N+1) and P(N−1) adjacent to the target point PN, which is the corner portion, is switched.

Figure 10:
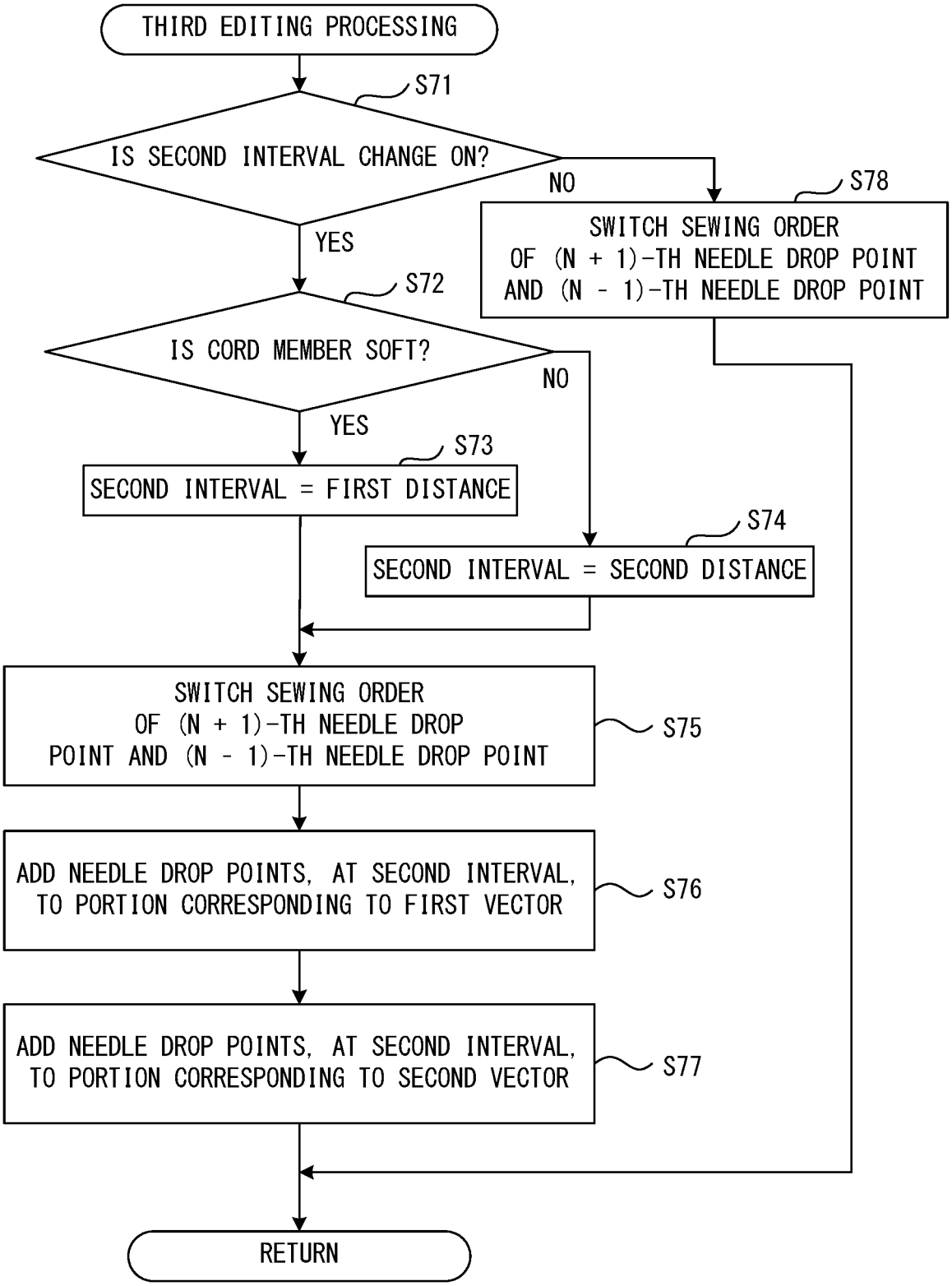
FIG. 10 is a flowchart of third editing processing performed in the sewing data editing processing shown in FIG. 6.

As shown in FIG. 10, the control portion 80 refers to the sewing conditions stored in the flash memory 84 and determines whether the second interval change is set to ON (step S71). When the second interval change is set to OFF (no at step S71), the control portion 80 switches the sewing order of the needle drop point P(N+1) and the needle drop point P(N−1) (step S78). As shown by a section J5 in FIG. 7, by the processing at step S78, the sewing order is switched such that, on the start point P0 side of the pattern J, the point P0, the point P(E−1), and the point P2 are sewn in that order, and, on the end point PE side of the pattern J, the point (E−2), the point P1, and the point PE are sewn in that order. In the section J5 shown in FIG. 7, the point P0, the point P(E−1), the point P1, and the point PE are examples of the plurality of first needle drop points corresponding to the corner portion, and the point P2, the point P3, the point P(E−3) and the point P(E−2) are examples of the second needle drop points corresponding to the non-corner portion.

When the second interval change is set to ON (yes at step S71), based on the coordinate data of each of the plurality of points and on the detection result of the corner portion at step S35, the control portion 80 edits the sewing data such that, in the pattern J, the interval between two of the first needle drop points that are consecutive in the sewing order, of the plurality of first needle drop points, is the second interval K2 that is shorter than the first interval K1. Specifically, in a similar manner to the processing at step S51, based on the type of the cord member C, the control portion 80 determines whether the cord member C is soft (step S72). When the cord member C is soft (yes at step S72), the control portion 80 sets the first distance as the second interval K2 (step S73). The first distances at step S52, at step S64, and at step S73 may be mutually different, or they may be the same distance. When the cord member C is not soft (no at step S72), the control portion 80 sets, as the second interval K2, the second distance that is longer than the first distance (step S74). The second distances at step S53, at step S65, and at step S74 may be mutually different, or they may be the same distance.

After step S73 or step S74, in a similar manner to step S78, the control portion 80 switches the sewing order of the needle drop point P(N+1) and the needle drop point P(N−1) (step S75). The control portion 80 adds needle drop points to the portion corresponding to the first vector V1 acquired at step S32, at the second interval K2 set at step S73 or step S74 (step S76). The control portion 80 adds needle drop points to the portion corresponding to the second vector V2 acquired at step S33, at the second interval K2 set at step S73 or step S74 (step S77). The control portion 80 here ends the third editing processing, and returns the processing to the sewing data editing processing shown in FIG. 6.

When the variable N is M, as shown by a section J2 in FIG. 7, an angle formed between the first vector V1 from a point PM toward a point P(M+1), and the second vector V2 from a point P(M−1) toward the point PM is determined not to be smaller than the threshold value (no at step S35), and the control portion 80 performs processing at step S41 to be described below. After one of step S37, step S39, or step S40, the control portion 80 updates the variable N (step S41). For example, the control portion 80 adds a predetermined number (1 for example) to the variable N and thus increments the variable N by the predetermined number. The control portion 80 determines whether the variable N is smaller than the number E that is the last number in the sewing order (step S42). When the variable N is smaller than the number E (yes at step S42), the control portion 80 returns the processing to step S32. When the variable N is not smaller than E (no at step S42), the control portion 80 here ends the sewing data editing processing, and returns the processing to the main processing shown in FIG. 4.

As shown in FIG. 4, after step S15, the control portion 80 captures an image of the sewing object (step S16). Specifically, the control portion 80 controls the movement mechanism 40, and moves the movement mechanism 40 to an image capture position. The image capture position is, for example, a position at which a center of a planned formation position of the pattern J represented by the sewing data edited at step S15 is aligned with a center of the image capture range of the imaging portion 69. The control portion 80 acquires the image data output from the imaging portion 69 (step S16). The control portion 80 displays, on the LCD 15, an image representing the plurality of sewing stitches indicated by the sewing data edited at step S15 in a superimposed manner on the captured image representing the sewing object captured by the imaging portion 69 (step S17). The user refers to the LCD 15 and checks a finished image of the pattern J.

Based on a detection result of the start/stop switch 29, the control portion 80 determines whether a sewing command to start the sewing based on the sewing data edited at step S15 has been detected (step S18). The control portion 80 stands by until the sewing command is detected (no at step S18). When the sewing command has been detected (yes at step S18), the control portion 80 drives the movement mechanism 40 and the needle bar mechanism 55 in accordance with the sewing data edited by the sewing data editing device, and performs the couching (step S19). At step S19, the sewing stitches are formed in accordance with the sewing data, in substantially the center, in the width direction, of the cord member C.

The control portion 80 determines whether a command has been detected to end the main processing (step S20). When ending the processing to perform the couching using the sewing machine 1, the user inputs an end command using the touch panel 26. When the command to end the processing has not been detected (no at step S20), the control portion 80 returns the processing to step S1. When the command to end the processing has been detected (yes at step S20), the control portion 80 here ends the main processing. Note that, in the processing at step S20, in addition to when the end command by the user has been detected, an affirmative determination is also made when the sewing has ended based on the sewing data, and the control portion 80 ends the main processing. As a result of the above-described main processing, in both the first and second examples, of the sewing data acquired at step S6 or step S10, the coordinate data representing the five corner portions of the acute angles of the pattern J is edited using the editing method in accordance with the set corner portion editing method, while the corner portion editing method is not applied to the coordinate data representing the non-corner portions and the sewing data acquired at step S6 or at step S10 is used as it is.

The sewing machine 1 of the above-described embodiment includes a function, as a sewing data editing device, that edits the sewing data for performing the couching, using the sewing machine 1, in which the cord member C is directly sewn onto the sewing object by forming the plurality of sewing stitches that penetrate the cord member C and the sewing object along the pattern J. The control portion 80 of the sewing machine 1 acquires the coordinate data indicating the positions of each of the plurality of points along the pattern J (step S4, step S10). Based on the coordinate data of each of the plurality of points, the control portion 80 detects the corner portion, in the pattern J, having an angle smaller than a predetermined angle (step S35). Based on the coordinate data of each of the plurality of points and on the detection result of the corner portion at step S35, the control portion 80 edits the sewing data using editing conditions that are mutually different for the plurality of first needle drop points corresponding to the corner portion, and for the plurality of second needle drop points corresponding to the non-corner portion at which the corner portion has not been detected (step S37, step S39, step S40). The sewing machine 1 can edit the sewing data using different conditions between the corner portions and the non-corner portions of the pattern J. According to the sewing machine 1, as a result of the user setting the editing conditions as appropriate, in comparison to a case in which the editing conditions for the corner portions and the non-corner portions of the pattern J are the same as each other, the cord member C is less likely to become detached from the sewing object at the corner portion, and it is possible to obtain the couching pattern having an attractive appearance.

The predetermined angle (threshold value) for detecting the corner portion is smaller than 90 degrees. Thus, the sewing machine 1 can detect the portion having the acute angle in the pattern J, as the corner portion, and can edit the sewing data using the different editing conditions for the corner portions and the non-corner portions of the pattern J. The sewing machine 1 can detect, as the corner portion, the acute angle portion where it is assumed that the cord member C easily becomes detached from the sewing object.

The control portion 80 acquires the coordinate data of each of the plurality of points that are disposed along the pattern J at the first interval K1 (step S6 step S10). In the first editing processing, based on the coordinate data of each of the plurality of points and on the detection result of the corner portion at step S35, the control portion 80 edits the sewing data such that, in the pattern J, the interval between the two of the first needle drop points that are consecutive in the sewing order, of the plurality of first needle drop points, is the second interval K2 that is shorter than the first interval K1 (S37). Thus, in comparison to a case in which the stitches are not increased locally at the corner portion, the sewing machine 1 contributes to sew the cord member C onto the sewing object at the corner portion more reliably, by the relatively simple processing of increasing the stitches locally at the corner portion along the pattern J. In the first and second examples, the sewing stitches formed by the sewing data are the running stitches that pass through the center, in the width direction, of the cord member C. Thus, with the sewing machine 1, when sewing the cord member C onto the sewing object, the stitches are not sewn beyond the width of the cord member C.

The control portion 80 acquires the coordinate data of each of the plurality of points disposed along the pattern J at the first interval K1 (step S6, step S10). Based on the coordinate data of each of the plurality of points and on the detection result of the corner portion at step S35, the control portion 80 sets the one or more needle drop points inside the triangular shape obtained by connecting, of the plurality of needle drop points, the target point that is the corner portion, and the two points that are adjacent to the target point (adjacent points), and edits the sewing data to the sewing data that forms the plurality of sewing stitches separated from the target point (step S39). Specifically, the control portion 80 moves the target point by a predetermined distance to an outside region of the pattern J, and, based on the target point after the movement and on the two adjacent points, sets the Bezier curve B. The control portion 80 sets the one or more needle drop points on the Bezier curve B. Thus, when the material of the cord member C is a relatively soft material such as wool or the like, since the number of stitches is suppressed from becoming large locally at the corner portion while still being able to increase the angle of the corner portion compared to before the editing, the sewing machine 1 contributes to sew the cord member C onto the sewing object at the corner portion more reliably while maintaining a feeling of softness of the cord member C.

The control portion 80 acquires the coordinate data of each of the plurality of points disposed along the pattern J at the first interval K1. Based on the coordinate data of each of the plurality of points and on the detection result of the corner portion at step S35, the control portion 80 edits the sewing data in which, of the plurality of points, the sewing order of the two points adjacent to the target point, which is the corner portion, is switched (step S40). Thus, when the material of the cord member C is a relatively soft material such as wool or the like, since the number of stitches is suppressed from becoming large locally at the corner portion, the sewing machine 1 contributes to sew the cord member C onto the sewing object at the corner portion more reliably while maintaining the feeling of softness of the cord member C.

Based on the coordinate data of each of the plurality of points and on the detection result of the corner portion at step S35, the control portion 80 edits the sewing data such that, in the pattern J, the interval between two of the first needle drop points that are consecutive in the sewing order, of the plurality of first needle drop points, is the second interval K2 that is shorter than the first interval K1 (step S68, step S69, step S76, step S77). By increasing the number of stitches locally along the pattern J at the corner portion of the pattern J, in comparison to a case in which the number of stitches does not change between the corner portion and the non-corner portion, the sewing machine 1 contributes to sew the cord member C onto the sewing object at the corner portion more reliably.

The control portion 80 identifies the type of the cord member C (step S51, step S62, step S72). The control portion 80 sets the second interval K2 depending on the identified type (step S52, step S53, step S64, step S65, step S73, step S74). Based on the coordinate data of each of the plurality of points and on the detection result of the corner portion at step S35, the control portion 80 edits the sewing data such that, in the pattern J, the interval between the two first needle drop points is the second interval K2 set at one of step S52, step S53, step S64, step S65, step S73, or step S74 (step S54, step S55, step S69, step S76, step S77). The sewing machine 1 can change the second interval K2 depending on the type of the cord member C. In comparison to when the second interval K2 is constant regardless of the type of the cord member C, the sewing machine 1 can edit the sewing data that forms the sewing stitches while taking into account the material, the thickness, and the softness of the cord member C.

The sewing machine 1 is provided with the LCD 15 and the touch panel 26, and the control portion 80 acquires the coordinate data of each of the plurality of points specified as desired on the LCD 15 by the user, via the touch panel 26 (step S4). The sewing machine 1 can edit the sewing data based on the plurality of points specified by the user via the touch panel 26. The sewing machine 1 contributes to improve convenience for the user when editing the sewing data.

The control portion 80 acquires the sewing data including the coordinate data (step S10), and, based on the coordinate data of each of the plurality of points and the detection result of the corner portion at step S35, edits the sewing data acquired at step S10 (step S37, step S39, step S40). Thus, the control portion 80 can use edit the sewing data using the already generated sewing data.

The sewing machine 1 is provided with the movement mechanism 40 configured to move the sewing object in a first direction and a second direction that is orthogonal to the first direction, and the needle bar mechanism 55 that includes the needle bar 6, to the lower end of which the sewing needle 7 is configured to be detachably mounted, and that is configured to drive the needle bar 6 to reciprocate in the up-down direction. The control portion 80 drives the movement mechanism 40 and the needle bar mechanism 55 in accordance with the sewing data edited at step S15, and performs the couching (step S19). Thus, the sewing machine 1 can edit the sewing data using the conditions that are different for the corner portion and the non-corner portion of the pattern J, and can perform the couching based on the edited sewing data. According to the sewing machine 1, as a result of the user setting the editing conditions as appropriate, in comparison to a case in which the editing conditions for the corner portions and the non-corner portions of the pattern J are the same as each other, the cord member C is less likely to become detached from the sewing object at the corner portion, and it is possible to obtain the couching pattern having the attractive appearance.

The sewing machine 1 is provided with the imaging portion 69 that captures the image of the sewing object, and with the LCD 15, and the control portion 80 displays, on the LCD 15, the image representing the plurality of sewing stitches indicated by the sewing data in the superimposed manner on the captured image representing the sewing object captured by the imaging portion 69 (step S17). Thus, with the sewing machine 1, since the image of the plurality of sewing stitches formed in accordance with the sewing data can be displayed in the superimposed manner on the captured image representing the sewing object that has been captured, the user can easily verify the finished image of the couching pattern.

The sewing data editing device, the non-transitory computer-readable medium, and the sewing machine of the present disclosure are not limited to the above-described embodiment, and various modifications may be made without departing from the broad spirit and scope of the present disclosure. For example, the following modifications may be added as appropriate.

(A) The configuration of the sewing machine 1, on which the presser device 2 and the embroidery frame 50 can be mounted, may be changed as appropriate. The sewing machine 1 may be an industrial sewing machine, or a multi-needle sewing machine. It is sufficient that the movement mechanism 40 be capable of moving the holder (the embroidery frame) in the left-right direction and the front-rear direction relative to the needle bar 6. The movement mechanism 40 may be configured integrally with the sewing machine 1. The shape and the size of the embroidery frame 50 may be changed as appropriate, and the shape may be circular, oval or the like, for example. The process of editing the sewing data may be performed by a general-purpose device such as a PC, or by a dedicated device. The configuration of the presser device 2 may be changed as appropriate, and the presser device 2 may have a configuration in which the position of the insertion hole 60 cannot be adjusted in the left-right direction with respect to the presser bar 8. The guide 21 may be provided not on the presser device 2 but on the sewing machine 1. The present disclosure can be realized in various modes, such as a program, a non-transitory computer-readable medium, and a sewing system, for example.

(B) The program including the instructions to execute the main processing shown in FIG. 4 may be stored in a storage device of the sewing machine 1 until the program is executed by the control portion 80. Thus, a program acquisition method, an acquisition path, and a device storing the program may be changed, respectively, as appropriate. The program executed by the control portion 80 may be received from another device via cable or wireless communication, and may be stored in a storage device, such as a flash memory or the like. The other device includes a PC, and a server connected via a network, for example.

(C) Each of the steps of the main processing of the sewing machine 1 is not limited to the example of being executed by the control portion 80, and part or all of the processing may be executed by another electronic device (an ASIC, for example). Each of the steps of the main processing may be executed by distributed processing by a plurality of electronic devices (a plurality of CPUs, for example). The order of each of the steps of the main processing may be changed, the step may be omitted, or a step may be added, as necessary. A mode in which part or all of the main processing is executed by an operating system (OS) or the like operated on the sewing machine 1 on the basis of instructions from the control portion 80 is also included in the scope of the present disclosure. For example, the following changes may be added to the main processing as appropriate.

The sewing machine 1 may be configured such that the corner portion editing method cannot be set, or may be configured such that the corner portion editing method is set automatically in accordance with a shape or the like of the pattern. Types of the corner portion editing method that can be set on the sewing machine 1 may be changed as appropriate, and a different method from the first to third editing methods may be applied. The different method from the first to third editing methods includes, for example, sewing the corner portion using zigzag stitches and sewing the non-corner portion using the running stitch, or the like, or a method in which a type of practical sewing is changed for the corner portion and the non-corner portion. In the first editing processing, the control portion 80 may perform processing to add the needle drop points to one of the portion corresponding to the first vector V1 or the portion corresponding to the second vector V2.

At step S6 or step S10, the control portion 80 may acquire the coordinate data of each of the plurality of needle drop points disposed along a predetermined pattern at the second interval K2, and when the corner portion is not determined at step S35, the control portion 80 may cause the interval between the second needle drop points at the non-corner portion to be wider than the interval between the first needle drop point at the corner portion, by changing the interval of the needle drop points of the non-corner portion from the second interval K2 to the first interval K1. Based on the graphic represented by the points specified by the user, the control portion 80 may directly generate the sewing data that fulfils the editing conditions, without provisionally generating the sewing data. In this case, for example, in the main processing, in place of the coordinate data of the needle drop points, the control portion 80 may read out coordinate data of points on the pattern and perform processing to detect the corner portion, and after performing processing as appropriate to edit the interval between the points and the arrangement of the points, may generate the sewing data. The control portion 80 may set the value of the second interval K2 to be constant, regardless of the type of the cord member C.

Figure 11:
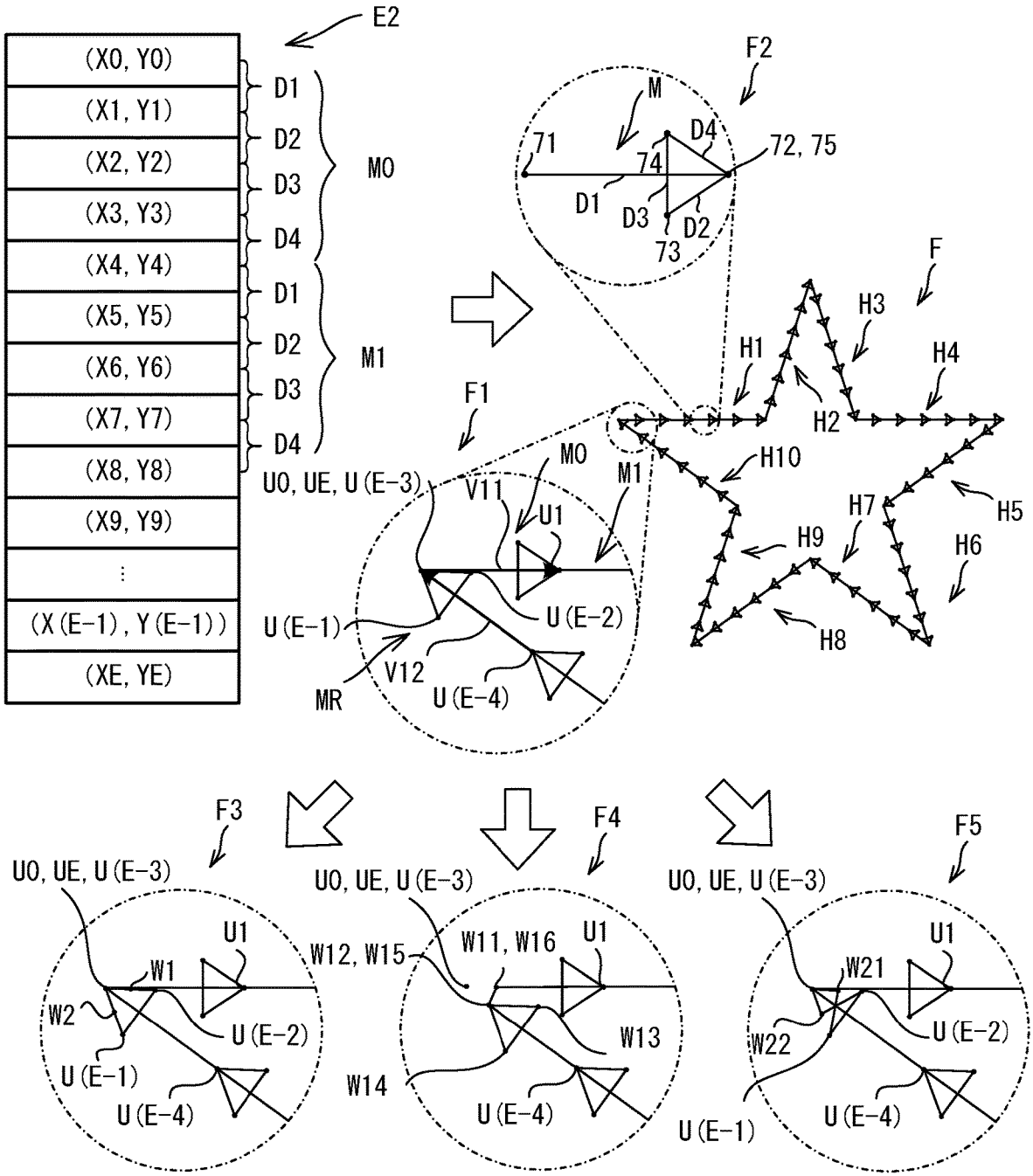
FIG. 11 is an explanatory diagram of a process in which sewing data of a pattern according to a modified example is edited by the sewing data editing processing shown in FIG. 6.

In the above-described embodiment, in addition to the running stitches, the sewing stitches for performing the couching may be zigzag sewing, practical sewing, or the like. An example will be explained of a case in which the above-described main processing is applied to the sewing data for forming an arrow-shaped motif M shown in a section F2 in FIG. 11, using sewing stitches disposed along a pattern F. As shown in FIG. 11, the motif M of a modified example is provided with 4 stitches D1 to D4 in the sewing order. The length of the motif M along a direction of a shape of a couching pattern (an extension direction of the stitch D1) is 2 to 15 mm, for example. The stitch D1 extends from a point 71 to a point 72, and is a main stitch having the longest length, among the stitches D1 to D4. The motif M is line symmetrical with respect to the stitch D1. The stitch D2 extends from the point 72 to a point 73. The stitch D3 extends from the point 73 to a point 74. The stitch D3 is shorter than the stitch D1, and is a sub-stitch that extends in a direction intersecting the stitch D1. Of the lengths of the stitches D1 to D4, the length of the stitch D3 is the next longest, after the stitch D1. The length of the stitch D3 is smaller than the thickness of the cord member C. The stitch D3 is orthogonal to the stitch D1, at a position closer to the center of the stitch D1 than to the position of the end point 72 of the stitch D1. The center of the stitch D3 is on the stitch D1. The stitch D4 extends from the point 74 to a point 75. The end point 72 of the stitch D1 is the same position as the end point 75 of the stitch D4. The last needle drop point 75 of the single motif M is the first needle drop point 71 of the motif M that is the next single motif M in the sewing order.

In the main processing at step S6 or step S10 relating to the pattern F of the modified example, sewing data E2 shown in FIG. 11 is acquired. As shown in FIG. 11, the sewing data E2 is represented by an absolute coordinate system of the X direction and the Y direction of the movement mechanism 40. The sewing data E2 represents the pattern F in which a plurality of the motifs M including motifs M1 and M2 are continuously disposed in the clockwise direction in a plan view, along 10 sides H1 to H10 included in the star-shaped pattern F. The stitches D1 of the motifs M are disposed on the sides H1 to H10. Six of the motifs M are continuously disposed on each of the sides H1 to H10. The size of each of the motifs M is the same. A sewing start point U0 of the pattern F is disposed at the left end of the side H1, for example. The pattern F is sewn continuously in the clockwise direction in a plan view, from the sewing start point U0.

In the sewing data editing processing shown in FIG. 6 relating to the pattern F of the modified example, it is sufficient that the variable N at step S31 be used for reading out the sewing order of the motif M. As shown by a section F1 in FIG. 11, at step S32, as a first vector V11, a vector from the start point toward the end point of the stitch D1 of an N-th motif MN is acquired, and at step S33, as the second vector V12, a vector from the start point toward the end point of the stitch D1 of an (N−1)-th motif M(N−1) is acquired. When the variable N is zero and the start point and the end point of the pattern F are the same coordinates, the (N−1)-th motif M(N−1) is a motif MR that is last in the sewing order. At this time, when it is determined that the angle calculated at step S34 is smaller than the threshold value (step S35) and the first editing processing is set as the corner portion editing processing (yes at step S36), as shown by a section F3 in FIG. 11, the control portion 80 may add needle drop points W1 and W2, at the second interval K2 that accords with the type of the cord member C, on the stitches D2 and D4 of the (N−1)-th motif MR, and may edit the sewing data such that the motif MR is sewn in order of a point U(E−4), a point U(E−3), the point W1, a point U(E−2), a point U(E−1), the point W2, and a point UE (step S37). When the second editing processing is set as the corner portion editing processing (no at step S36; yes at step S38), as shown by a section F4 in FIG. 11, the control portion 80 may shorten a length, in a lengthwise direction, of an N-th (0-th) motif M0 and of the (N−1)-th (R-th) motif MR by a predetermined distance, may delete from the point U(E−3) to the point UE and the point U0, such that the start point of the motif M0 and the end point of the motif MR are joined, may set points W11 to W16, and edit the sewing data. When the third editing processing is set as the corner portion editing processing (no at step S36; no at step S38), as shown by a section F5 in FIG. 11, the control portion 80 may add needle drop points W21 and W22 at center points of the stitches D2 and D4 of the (N−1)-th motif MR, and may edit the sewing data such that the motif MR is sewn in order of the point U(E−4), the point U(E−3), the point W21, the point U(E−1), the point U(E−2), the point W22, and the point UE (step S40). The above-described modified examples may be combined as appropriate insofar as no contradictions arise.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing data editing device comprising:

a processor; and a memory configured to store computer-readable instructions that, when executed by the processor, instruct the processor to perform processes comprising:

acquisition processing of acquiring coordinate data representing a position of each of a plurality of points along a predetermined pattern;

corner portion detection processing of detecting, based on the coordinate data of each of the plurality of points, a corner portion, in the predetermined pattern, having an angle smaller than a predetermined angle; and editing processing of editing sewing data, based on the coordinate data of each of the plurality of points and on a detection result of the corner portion detection processing, using editing conditions that are mutually different for a plurality of first needle drop points corresponding to the corner portion and for a plurality of second needle drop points corresponding to a non-corner portion not detected as the corner portion, in the predetermined pattern, the sewing data being data for performing couching, using a sewing machine, to directly sew a cord member onto a sewing object, by forming a plurality of sewing stitches penetrating the cord member and the sewing object along the predetermined pattern.

2. The sewing data editing device according to claim 1, wherein the predetermined angle is smaller than 90 degrees.

3. The sewing data editing device according to claim 1, wherein the acquisition processing includes acquiring the coordinate data of each of the plurality of points disposed at a first interval along the predetermined pattern, and the editing processing includes editing the sewing data, based on the coordinate data of each of the plurality of points and on the detection result, to cause an interval between two of the first needle drop points that are consecutive in a sewing order, of the plurality of first needle drop points in the predetermined pattern, to be a second interval shorter than the first interval.

4. The sewing data editing device according to claim 1, wherein the acquisition processing includes acquiring the coordinate data of each of the plurality of points disposed at a first interval along the predetermined pattern, and the editing processing includes editing the sewing data, based on the coordinate data of each of the plurality of points and on the detection result, in which at least one needle drop point is set inside a triangular shape obtained by connecting, of the plurality of points, a target point that is the corner portion and two points adjacent to the target point, and the plurality of sewing stitches are formed to be separated from the target point.

5. The sewing data editing device according to claim 1, wherein the acquisition processing includes acquiring the coordinate data of each of the plurality of points disposed at a first interval along the predetermined pattern, and the editing processing includes editing the sewing data, based on the coordinate data of each of the plurality of points and on the detection result, to cause, of the plurality of points, a sewing order to be switched of two points adjacent to a target point that is the corner portion.

6. The sewing data editing device according to claim 4, wherein the editing processing includes editing the sewing data, based on the coordinate data of each of the plurality of points and on the detection result, to cause an interval between two of the first needle drop points that are consecutive in a sewing order, of the plurality of first needle drop points in the predetermined pattern, to be a second interval shorter than the first interval.

7. The sewing data editing device according to claim 3, wherein the computer-readable instructions further instruct the processor to perform processes comprising:

identification processing of identifying a type of the cord member; and setting processing of setting the second interval in accordance with the type identified by the identification processing, and the editing processing includes editing the sewing data, based on the coordinate data of each of the plurality of points and on the detection result, to cause the interval between the two first needle drop points in the predetermined pattern to be the second interval set by the setting processing.

8. The sewing data editing device according to claim 1, further comprising:

a display portion; and an input portion, wherein the acquisition processing includes acquiring the coordinate data of each of the plurality of points specified as desired on the display portion by a user, via the input portion.

9. The sewing data editing device according to claim 1, wherein the acquisition processing includes acquiring the sewing data including the coordinate data, and the editing processing includes editing the sewing data acquired by the acquisition processing, based on the coordinate data of each of the plurality of points and on the detection result.

10. A non-transitory computer-readable medium storing computer-readable instructions that are executed by a processor of a sewing data editing device, the computer-readable instructions performing processes comprising:

acquisition processing of acquiring coordinate data representing a position of each of a plurality of points along a predetermined pattern;

corner portion detection processing of detecting, based on the coordinate data of each of the plurality of points, a corner portion, in the predetermined pattern, having an angle smaller than a predetermined angle; and editing processing of editing sewing data, based on the coordinate data of each of the plurality of points and on a detection result of the corner portion detection processing, using editing conditions that are mutually different for a plurality of first needle drop points corresponding to the corner portion and for a plurality of second needle drop points corresponding to a non-corner portion not detected as the corner portion, in the predetermined pattern, the sewing data being data for performing couching, using a sewing machine, to directly sew a cord member onto a sewing object, by forming a plurality of sewing stitches penetrating the cord member and the sewing object along the predetermined pattern.

11. A sewing machine comprising:

a movement mechanism including a motor configured to move a sewing object in a first direction and a second direction orthogonal to the first direction;

a needle bar mechanism including a needle bar to a lower end of which a sewing needle is detachably mounted, the needle bar mechanism being configured to drive the needle bar to reciprocate in an up-down direction;

a processor; and a memory configured to store computer-readable instructions that, when executed by the processor, instruct the processor to perform processes comprising:

acquisition processing of acquiring coordinate data representing positions of each of a plurality of points along a predetermined pattern;

corner portion detection processing of detecting, based on the coordinate data of each of the plurality of points, a corner portion, in the predetermined pattern, having an angle smaller than a predetermined angle;

editing processing of editing sewing data, based on the coordinate data of each of the plurality of points and on a detection result of the corner portion detection processing, using editing conditions that are mutually different for a plurality of first needle drop points corresponding to the corner portion and for a plurality of second needle drop points corresponding to a non-corner portion not detected as the corner portion, in the predetermined pattern, the sewing data being data for performing couching, using the sewing machine, to directly sew a cord member onto the sewing object, by forming a plurality of sewing stitches penetrating the cord member and the sewing object along the predetermined pattern; and sewing control processing of driving the movement mechanism and the needle bar mechanism in accordance with the sewing data edited at the editing processing, and performing the couching.

12. The sewing machine according to claim 11, further comprising:

an imaging portion configured to capture an image of the sewing object; and a display portion, wherein the computer-readable instructions further instruct the processor to perform a process comprising:

display control processing of displaying, on the display portion, an image representing the plurality of sewing stitches indicated by the sewing data, in a superimposed manner on a captured image representing the sewing object captured by the imaging portion.

* * * * *